US010265949B2

(12) United States Patent
Matsumoto

(10) Patent No.: US 10,265,949 B2
(45) Date of Patent: Apr. 23, 2019

(54) LIQUID DISCHARGE APPARATUS

(71) Applicant: SEIKO EPSON CORPORATION, Tokyo (JP)

(72) Inventor: Yusuke Matsumoto, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/840,021

(22) Filed: Dec. 13, 2017

(65) Prior Publication Data

US 2018/0170038 A1 Jun. 21, 2018

(30) Foreign Application Priority Data

Dec. 21, 2016 (JP) ..... 2016-247650

(51) Int. Cl.
*B41J 2/045* (2006.01)
*B41J 2/14* (2006.01)

(52) U.S. Cl.
CPC ..... *B41J 2/04541* (2013.01); *B41J 2/04581* (2013.01); *B41J 2/04588* (2013.01); *B41J 2/04593* (2013.01); *B41J 2/14201* (2013.01); *B41J 2002/14491* (2013.01); *B41J 2202/20* (2013.01)

(58) Field of Classification Search
CPC .. B41J 2/1607; B41J 2/04581; B41J 2/04588; B41J 2/04593; B41J 2/14201; B41J 2/04541; B41J 2002/14491; B41J 2002/20
See application file for complete search history.

(56) References Cited

U.S. PATENT DOCUMENTS 6,270,193 B1 * 8/2001 Hiwada ..... B41J 2/1609 347/50
9,878,535 B2 * 1/2018 Kaneko ..... B41J 2/04563
2009/0027437 A1 1/2009 Azami et al.

FOREIGN PATENT DOCUMENTS

JP 2009-028913 A 2/2009
JP 2010-221500 A 10/2010

* cited by examiner

*Primary Examiner* — Lamson D Nguyen

(57) ABSTRACT

A liquid discharge apparatus includes a first head unit configured to discharge a liquid, a second head unit configured to discharge a liquid, a first drive circuit configured to drive the first head unit, a second drive circuit configured to drive the second head unit, a circuit board on which the first drive circuit and the second drive circuit are provided, and a case that accommodates the circuit board. The case includes an inlet through which gas outside the case flows inside the case, and an outlet through which gas inside the case flows to the outside the case, and the first drive circuit generates more heat than the second drive circuit, and a distance between the first drive circuit and the inlet is shorter than a distance between the second drive circuit and the inlet.

7 Claims, 10 Drawing Sheets

| | SI[m] (b1, b2) | Ts1 | | Ts2 | |
|---|---|---|---|---|---|
| | | SLa [m] | SLb [m] | SLa [m] | SLb [m] |
| LARGE DOT | (1, 1) | H | L | H | L |
| MEDIUM DOT | (1, 0) | H | L | L | H |
| SMALL DOT | (0, 1) | L | H | H | L |
| NON-RECORD | (0, 0) | L | H | L | H |

LIQUID DISCHARGE APPARATUS

This application claims priority to Japanese Patent Application No. 2016-247650 filed on Dec. 21, 2016. The entire disclosure of Japanese Patent Application No. 2016-247650 is hereby incorporated herein by reference.

BACKGROUND

1. Technical Field

The present invention relates to a liquid discharge apparatus.

2. Related Art

Liquid discharge apparatuses such as an ink jet printer perform print processing by driving discharge sections provided in a head unit and discharging liquid such as ink filled in cavities (pressure chambers) in the discharge sections from nozzles in the discharge sections to form an image on a recording medium. In order to increase the printing speed or to respond to the demands for increasing the resolution and size of images to be formed, a plurality of head units are provided in some liquid discharge apparatuses. Such liquid discharge apparatuses having the plurality of head units are usually provided with a plurality of drive circuits for generating drive signals to be supplied to each of the head units (for example, see JP-A-2009-028913 and JP-A-2010-221500).

The drive signals for driving a discharge section are signals of large amplitude and drive circuits generate heat when generating the drive signals. Accordingly, when the plurality of drive circuits simultaneously generate drive signals, the temperature of circuit boards having the drive circuits increases. Such high temperature may cause the drive circuits to operate unstably, liquid discharge apparatuses to produce low-quality image, and further, cause the drive circuits to fail.

SUMMARY

An advantage of some aspects of the invention is that there is provided a technique, in a liquid discharge apparatus that includes a plurality of drive circuits, for reducing occurrence of troubles such as image quality decrease and drive circuit failures due to heat generated by the drive circuits.

To solve the problem, a liquid discharge apparatus includes a first head unit configured to discharge a liquid, a second head unit configured to discharge a liquid, a first drive circuit configured to drive the first head unit, a second drive circuit configured to drive the second head unit, a circuit board on which the first drive circuit and the second drive circuit are provided, and a case that accommodates the circuit board. The case includes an inlet through which gas outside the case flows inside the case, and an outlet through which gas inside the case flows to the outside the case, and the first drive circuit generates more heat than the second drive circuit, and a distance between the first drive circuit and the inlet is shorter than a distance between the second drive circuit and the inlet.

According to this aspect, the first drive circuit that generates more heat than the second drive circuit is disposed near the inlet. With this configuration, the first drive circuit that generates more heat can be efficiently cooled. Consequently, troubles such as image quality decrease and drive circuit failures due to heat generated by the drive circuits can be reduced.

In this liquid discharge apparatus, the first drive circuit and the second drive circuit may be located between the inlet and the outlet.

With this configuration, the first drive circuit and the second drive circuit are located in a flow path of gas that flows from the inlet toward the outlet. Consequently, the first drive circuit and the second drive circuit can be efficiently cooled.

This liquid discharge apparatus may further include a power supply circuit configured to supply electric power to the first drive circuit and a capacitor for power supply, the capacitor being electrically connected to the first drive circuit and the power supply circuit. The capacitor for power supply may be disposed on the circuit board and located between the inlet and the outlet.

With this configuration, a capacitor for power supply, the capacitor being electrically connected to the first drive circuit and the power supply circuit, is disposed near the inlet. Accordingly, the capacitor for power supply can be effectively cooled, and thereby stable electric power can be supplied to the first drive circuit.

The liquid discharge apparatus may further include a line head including the first head unit and the second head unit, the line head extending in a predetermined direction. A distance between a central section of the line head in the predetermined direction and the first head unit may be shorter than a distance between the central section and the second head unit.

In this configuration, the first head unit is used more frequently than the second head unit, and the first drive circuit corresponding to the first head unit is disposed near the inlet. Accordingly, the first drive circuit that generates more heat than the second drive circuit can be efficiently cooled.

In this liquid discharge apparatus, the first drive circuit may include a first generation circuit configured to generate a first drive waveform signal for driving the first head unit, and a second generation circuit configured to generate a second drive waveform signal for driving the first head unit, and the second drive circuit may include a third generation circuit configured to generate a third drive waveform signal for driving the second head unit, and a fourth generation circuit configured to generate a fourth drive waveform signal for driving the second head unit. The first generation circuit may generate more heat than the second generation circuit, the third generation circuit may generate more heat than the fourth generation circuit, and a distance between the first generation circuit and the second generation circuit may be shorter than a distance between the first generation circuit and the third generation circuit.

With this configuration, the third generation circuit is closer to the second generation circuit than the first generation circuit. Accordingly, troubles of the circuit board due to the heat sources concentrated in one area on the circuit board can be reduced.

In the liquid discharge apparatus, the first drive circuit may include a first generation circuit configured to generate a first drive waveform signal for driving the first head unit, and a second generation circuit configured to generate a second drive waveform signal for driving the first head unit, the second drive circuit may include a third generation circuit configured to generate a third drive waveform signal for driving the second head unit, and a fourth generation circuit configured to generate a fourth drive waveform signal for driving the second head unit. An amplitude of the first drive waveform signal may be larger than an amplitude of the second drive waveform signal, an amplitude of the third drive waveform signal may be larger than an amplitude of the fourth drive waveform signal, and a distance between the first generation circuit and the second generation circuit may be shorter than a distance between the first generation circuit and the third generation circuit.

With this configuration, the third generation circuit is closer to the second generation circuit than the first generation circuit. Accordingly, troubles of the circuit board due to the heat sources concentrated in one area on the circuit board can be reduced.

In this configuration, a distance between the third generation circuit and the fourth generation circuit may be shorter than a distance between the third generation circuit and the first generation circuit.

with this configuration, the fourth generation circuit is closer to the third generation circuit than the first generation circuit. Accordingly, troubles of the circuit board due to the heat sources concentrated in one area on the circuit board can be reduced.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
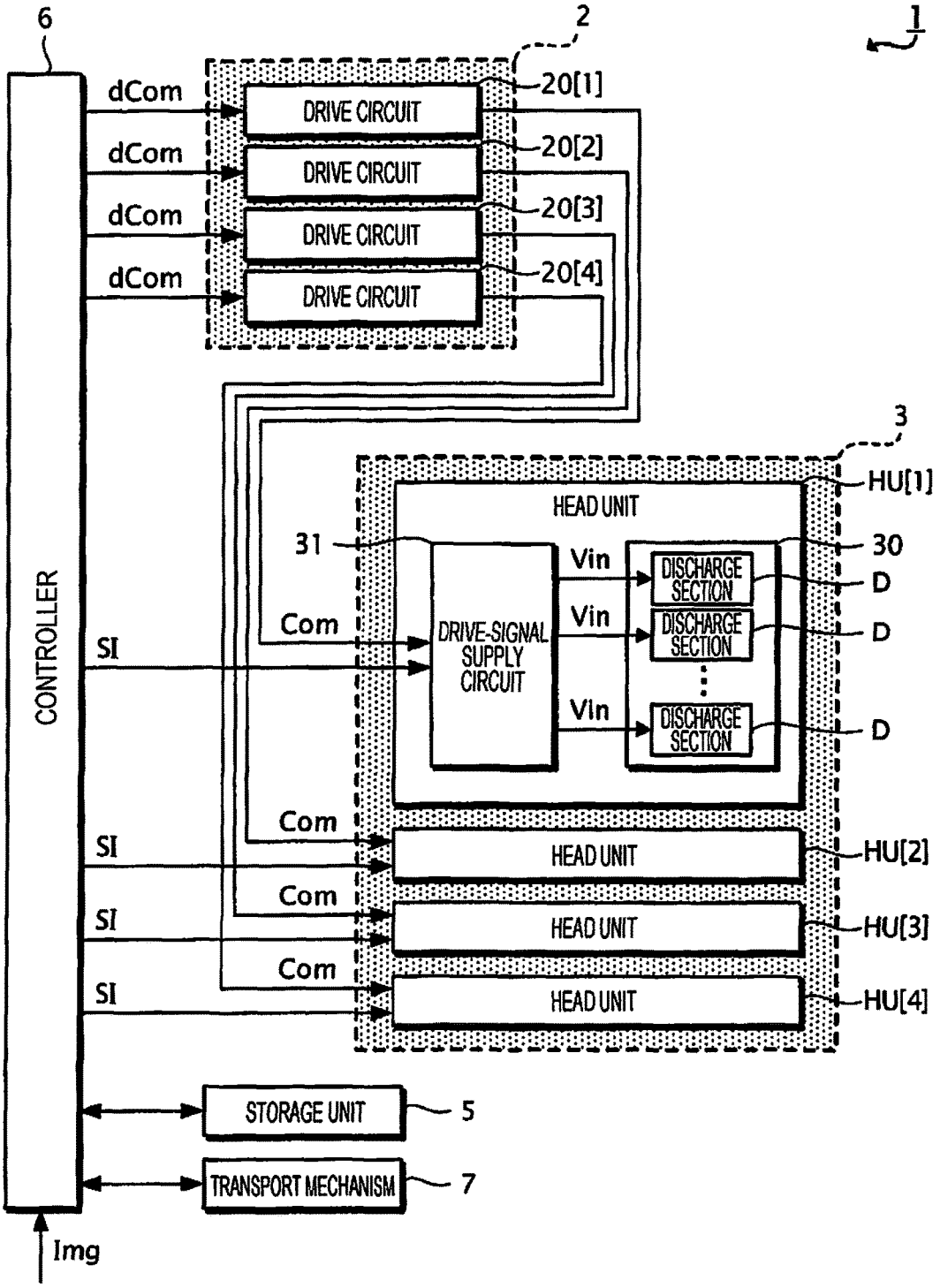
FIG. 1 is a functional block diagram of the ink jet printer according to the embodiment.

Hereinafter, embodiments of the invention will be described with reference to the drawings. In the drawings, the size and scaling ratio of each section are appropriately changed from those of actual sections. Although various technically preferred limitations are given in the embodiment described below in order to illustrate a specific preferred example of the invention, it should be noted that the scope of the invention is not intended to be limited to the embodiment unless such limitations are explicitly mentioned hereinafter.

A. Embodiment

As an example liquid discharge apparatus, this embodiment uses an ink jet printer that forms an image on recording paper P, which is an example "recording medium", by discharging ink, which is an example "liquid".

1. Outline of Ink Jet Printer

With reference to FIG. 1, a configuration of an ink jet printer 1 according to the embodiment will be described. FIG. 1 is a functional block diagram of the ink jet printer 1 according to the embodiment.

To the ink jet printer 1, from a host computer (not illustrated) such as a personal computer, a digital camera, or the like, print data Img that represents an image to be formed by the ink jet printer 1 is supplied. The ink jet printer 1 performs print processing for forming on recording paper P the image represented by the print data Img, which is supplied from the host computer. Although details will be described below, in this embodiment, it is assumed that the ink jet printer 1 is a line printer.

As illustrated in FIG. 1, the ink jet printer 1 includes a liquid discharge head 3, a controller 6, a drive-signal generation module 2 that has drive circuits 20, a transport mechanism 7, and a storage unit 5. The liquid discharge head 3 includes head units HU that have discharge sections D for discharging ink. The controller 6 controls operations of the components in the ink jet printer 1. Each drive circuit 20 generates a drive signal Com for driving the liquid discharge head 3, more specifically, the discharge sections D in the liquid discharge head 3. The transport mechanism 7 changes a relative position of the recording paper P with respect to the liquid discharge head 3. The storage unit 5 stores a control program for the ink jet printer 1 and other information.

As illustrated in FIG. 1, in this embodiment, it is assumed that the liquid discharge head 3 includes four head units HU, and the drive-signal generation module 2 includes four drive circuits 20 that correspond respectively to the four head units HU. In the following description, each of the four head units HU may be expressed with a subscript [q] in order to distinguish each of the head units HU (variable q is a natural number that satisfies $1 \leq q \leq 4$). Similarly, to distinguish each of the four drive circuits 20, a subscript [q] may be added. In this embodiment, as described above, the four head units HU[1] to HU[4] respectively correspond to the four drive circuits 20[1] to 20[4] in a one-to-one relationship. Accordingly, the drive circuit that corresponds to a head unit HU[q] is a drive circuit 20[q].

In this embodiment, each of the four head units HU[1] to HU[4] includes the discharge module 30 that has M discharge sections D and a drive signal supply circuit 31 that switches between whether or not to supply the drive signal Com, which has been output by the drive-signal generation module 2, to the discharge module 30 (in this embodiment, M is a natural number that satisfies $1 \leq M$). In order to distinguish each of the M discharge sections D provided in each discharge module 30, the discharge sections D may be referred to as a first stage, a second stage, . . . , M stage in order. The discharge section D in the m stage may be referred to as a discharge section D[m] (the variable m is a natural number that satisfies $1 \leq m \leq M$). A component, signal, and the like in the ink jet printer 1 that correspond to the number of the stage m of the discharge section D[m] may be expressed with a subscript [m] that is added to indicate that the component, signal, and the like correspond to the number of the stage m.

The storage unit 5 includes, for example, a volatile memory such as a random access memory (RAM) and a nonvolatile memory such as a read-only memory (ROM), electrically erasable programmable read-only memory (EEPROM), or a programmable ROM (PROM). The storage unit 5 stores various kinds of information such as the print data Img, which is supplied from a host computer, and a control program for the ink jet printer 1.

The controller 6 includes a central processing unit (CPU). Alternatively, instead of the CPU, the controller 6 may include a programmable logic device such as a field-programmable gate array (FPGA). The controller 6 controls each component in the ink jet printer 1 by enabling a control program that is stored in the storage unit 5 to be executed by the CPU in the controller 6. Specifically, the controller 6 generates a print signal SI for controlling each drive signal supply circuit 31, which is provided in the liquid discharge head 3, a waveform-designating signal dCom for controlling each of the four drive circuits 20[1] to 20[4], which are provided in the drive-signal generation module 2, and a signal for controlling the transport mechanism 7. The waveform-designating signal dCom is a digital signal for designating a waveform of a drive signal Com. The drive signal Com is an analog signal for driving the discharge sections D. The drive circuit 20 includes a digital-to-analog (D/A) conversion circuit and generates the drive signal Com that has a waveform designated by the waveform-designating signal dCom. The print signal SI is a digital signal for designating a mode of operation of the discharge sections D. Specifically, the print signal SI designates whether or not to supply the drive signal Com to the discharge section D to designate a mode of operation of the discharge section D. Designating the mode of operation of the discharge section D includes, for example, designating whether or not to drive the discharge sections D, designating whether or not to discharge ink from the discharge sections D when the discharge sections D are driven, and designating amounts of ink to be discharged from the discharge sections D when the discharge sections D are driven.

To perform print processing, the controller 6 instructs the storage unit 5 to store the print data Img supplied from a host computer. Then, in accordance with the various kinds of data stored in the storage unit 5 such as the print data Img, the controller 6 generates various control signals such as the print signal SI, the waveform-designating signal dCom, and the signal for controlling the transport mechanism 7. In accordance with the control signals and the various kinds of data stored in the storage unit 5, the controller 6 controls the transport mechanism 7 such that the relative position of the recording paper P with respect to the liquid discharge head 3 is changed and controls the liquid discharge head 3 such that the discharge sections D are driven. With these operations, the controller 6 determines whether or not to discharge ink from the discharge sections D, the discharge amount of ink, the timing for discharging the ink, and the like to control the print processing for forming an image corresponding to the print data Img on the recording paper P.

2. Outline of Drive-Signal Generation Module

Figure 2:
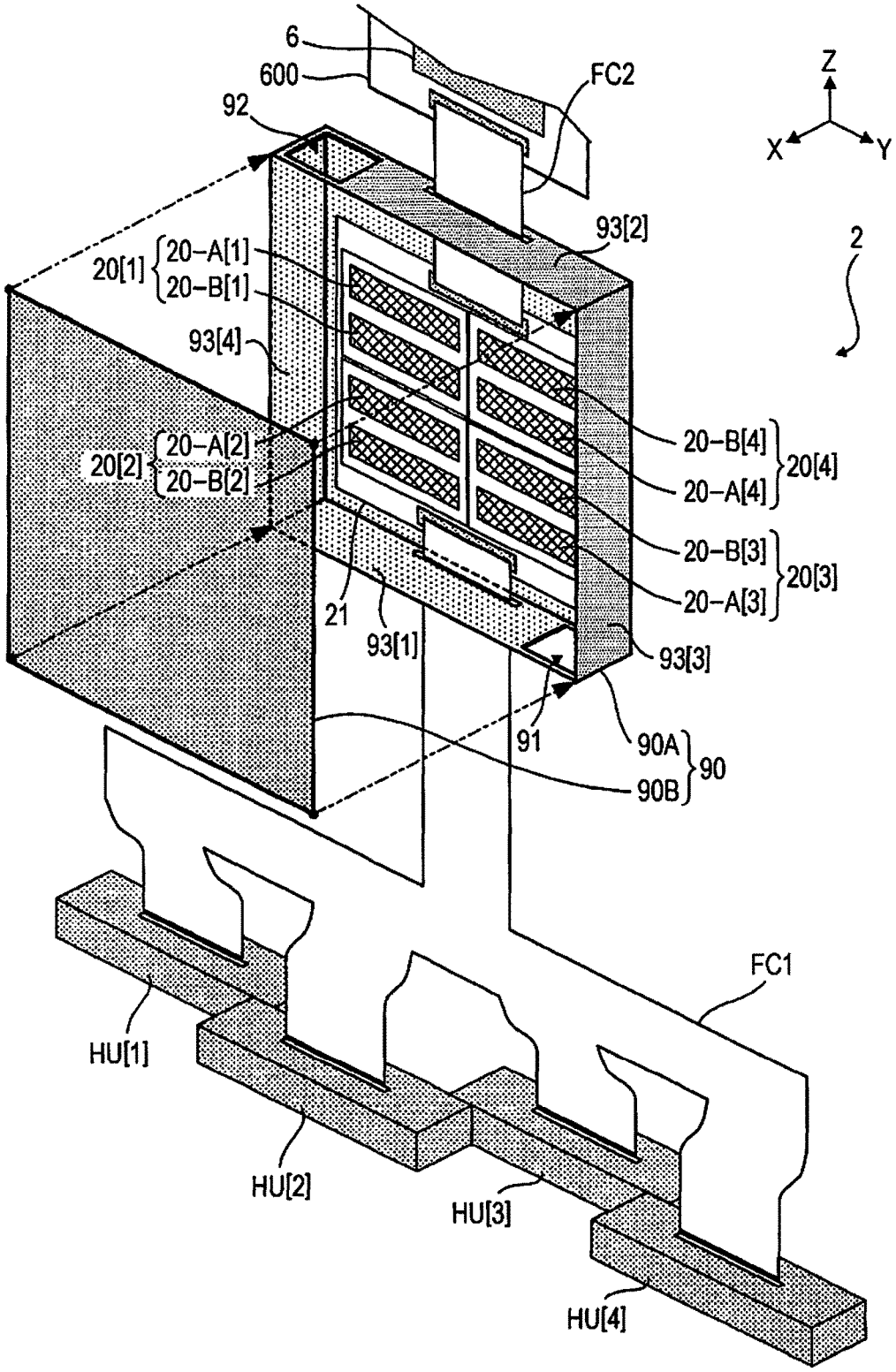
FIG. 2 illustrates a structure of a drive-signal generation module and an example of electrical connection between the drive-signal generation module and four head units.

Hereinafter, an outline of the drive-signal generation module 2 will be described with reference to FIG. 2. FIG. 2 illustrates a structure of the drive-signal generation module 2 and an example of electrical connection between the drive-signal generation module 2 and the four head units HU[1] to HU[4].

As illustrated in FIG. 2, the drive-signal generation module 2 includes a circuit board 21 on which the four drive circuits 20[1] to 20[4] are provided and a shielding case 90 that accommodates the circuit board 21. The shielding case 90 is an example case, and includes a storage section 90A that has a recessed section for accommodating the circuit board 21 and a cover 90B that covers an opening of the storage section 90A. The storage section 90A includes an inlet 91 through which air (an example of "gas") outside the shielding case 90 flows into the inside (a space defined by the recessed section of the storage section 90A and the cover 90B) of the shielding case 90, and an outlet 92 through which air in the shielding case 90 flow away to the outside of the shielding case 90.

In this embodiment, it is assumed that an installation surface on which the ink jet printer 1 is installed, that is, an X-Y plane (plane that is parallel to an X axis and a Y axis) is a plane that is perpendicular to a Z axis. In the embodiment in FIG. 2, the rectangular shielding case 90 is disposed such that the opening (the surface that has the opening) of the storage section 90A is parallel to a Y-Z plane (plane that is parallel to the Y axis and the Z axis). The storage section 90A includes first to fourth wall sections 93[1] to 93[4]. The space surrounded by the first to fourth wall sections 93[1] to 93[4] is the recessed section for storing the circuit board 21.

In the embodiment in FIG. 2, the inlet 91 is provided on the first wall section 93[1] that is parallel to the X-Y plane. Specifically, the inlet 91 is provided at an end portion of the first wall section 93[1] on a +Y side. The outlet 92 is provided at an end portion of the second wall section 93[2] on a −Y side. Air that has flowed into the shielding case 90 through the inlet 91 flows from the inlet 91 toward the outlet 92 and flows away from the outlet 92. Air flowing inside the shielding case 90 cools various electronic components (including the drive circuit 20[q]) that are provided on the circuit board 21.

As illustrated in FIG. 2, the circuit board 21 is electrically connected to each of the four head units HU[1] to HU[4], which are provided in the liquid discharge head 3, through a flexible printed circuit board FC1. The circuit board 21 is also electrically connected to a control circuit board 600, on which the controller 6 is provided, through a flexible printed circuit board FC2.

As will be described below in detail, in this embodiment, it is assumed that a drive signal Com for driving the discharge sections D in the liquid discharge head 3 includes a drive waveform signal Com-A and a drive waveform signal Com-B. One head unit HU[q] is driven by the drive waveform signal Com-A and the drive waveform signal Com-B.

The drive circuit 20[q] includes the generation circuit 20-A[q] that generates a drive waveform signal Com-A and a generation circuit 20-B[q] that generates a drive waveform signal Com-B. The generation circuit 20-A[q] and the generation circuit 20-B[q] may be collectively referred to as a generation circuit 20-P[q] when it is not necessary to distinguish them. The variable P is A or B.

The drive circuits 20[1] to 20[4] are cooled by air that flows inside the shielding case 90. In this embodiment, to increase the cooling efficiency, the drive circuits 20[1] to 20[4] are arranged on the circuit board 21 as described below.

The drive circuit 20[2] and the drive circuit 20[3] are disposed below (−Z side) the drive circuit 20[1] and the drive circuit 20[4], that is, the drive circuit 20[2] and the drive circuit 20[3] are disposed at positions closer to the inlet 91 than the outlet 92.

Although not illustrated in FIG. 2, on the flexible printed circuit board FC1, wiring for electrically connecting the generation circuit 20-A[q] and the drive signal supply circuit 31 in the head unit HU[q] and wiring for electrically connecting the generation circuit 20-B[q] and the drive signal supply circuit 31 in the head unit HU[q] are provided. On the flexible printed circuit board FC2, wiring for electrically connecting the generation circuit 20-A[q] and the controller 6 and wiring for electrically connecting the generation circuit 20-B[q] and the controller 6 are provided.

In this embodiment, the flexible printed circuit boards are used to connect the head unit HU[q] and the circuit board 21 and the circuit board 21 and the control circuit board 600. Alternatively, flexible flat cables or other cables may be used to connect the head unit HU[q] and the circuit board 21 and the circuit board 21 and the control circuit board 600. In this embodiment, the drive-signal generation module 2 is disposed outside the liquid discharge head 3, however, the drive-signal generation module 2 may be provided in the liquid discharge head 3.

A fan for making gas to flow through the inlet 91 into the shielding case 90 may be provided outside the shielding case 90 and near the inlet 91. Furthermore, a fan for sucking gas inside the shielding case 90 through the outlet 92 may be provided outside the shielding case 90 and near the outlet 92.

3. Outline of Inner Structure of Ink Jet Printer 1

Figure 3:
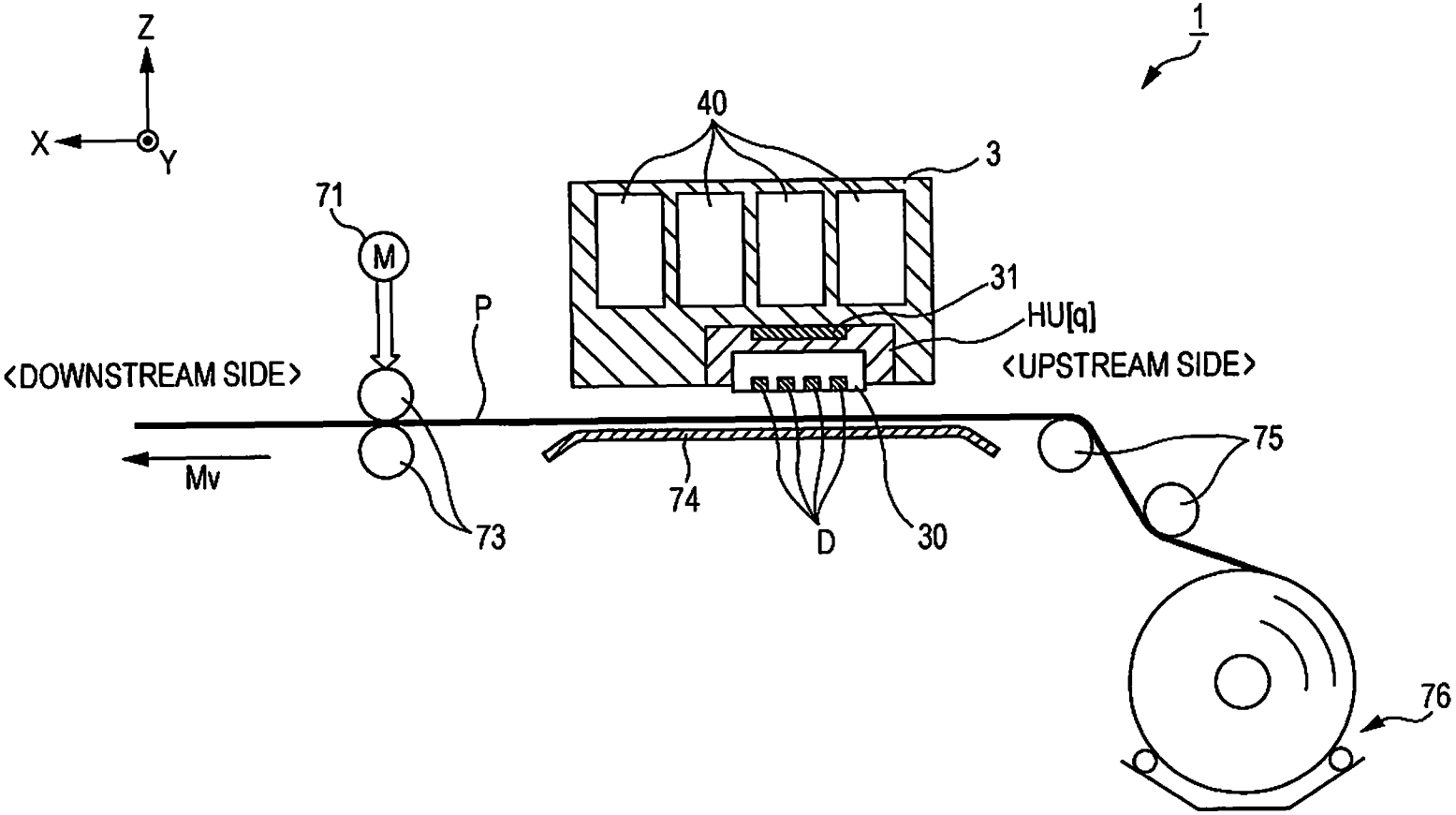
FIG. 3 is a partially sectional view schematically illustrating an inner structure of the ink jet printer.

FIG. 3 is a partially sectional view schematically illustrating an inner structure of the ink jet printer 1. As illustrated in FIG. 3, in this embodiment, it is assumed that the ink jet printer 1 is provided with four ink cartridges 40. In FIG. 3, the ink cartridges 40 are provided in the liquid discharge head 3; however, the ink cartridges 40 may be provided at other locations in the ink jet printer 1. These four ink cartridges 40 correspond to four respective colors (CMYK) of cyan, magenta, yellow, and black. Each ink cartridge 40 is filled with an ink of a color correspondingly assigned to the ink cartridge 40.

As illustrated in FIG. 3, the transport mechanism 7 includes a transporting motor 71, a motor driver (not illustrated), a platen 74, transport rollers 73, guide rollers 75, and a storage section 76. The transporting motor 71 is a drive source for transporting the recording paper P, and the motor driver drives the transporting motor 71. The platen 74 is disposed below (−Z direction in FIG. 3) the liquid discharge head 3. The transport rollers 73 are rotated when the transporting motor 71 operates. The guide rollers 75 are rotatable about the Y-axes in FIG. 3, respectively. The storage section 76 stores the recording paper P in a state in which the recording paper P is wound in a rolled state. When the ink jet printer 1 performs print processing, the transport mechanism 7 feeds the recording paper P from the storage section 76 and transports the recording paper P in the +X direction (the direction from the upstream side toward the downstream side (hereinafter, may be referred to as a "transport direction Mv")) in the drawing along a transport path that is defined by the guide rollers 75, the platen 74, and the transport rollers 73. In the description below, as illustrated in FIG. 3, the +X direction (transport direction Mv) and the opposing −X direction are collectively referred to as the X-axis direction, the +Z direction (upward direction) and the opposing −Z direction (downward direction) are collectively referred to as the Z-axis direction, and the +Y direction that intersects the X-axis direction and the Z-axis direction and the opposing −Y direction are collectively referred to as the Y-axis direction.

To each of the 4M discharge sections D provided in the liquid discharge head 3, an ink is supplied from one of the four ink cartridges 40. Each discharge section D can store the ink supplied from the ink cartridge 40 therein and discharge the stored ink from nozzles N (see FIG. 4) that are provided in the discharge section D. Specifically, while the transport mechanism 7 transports the recording paper P on the platen 74, each discharge section D discharges the ink onto the recording paper P to form dots that constitute an image. From the 4M discharge sections D that are provided in the four head units HU[1] to HU[4] in the liquid discharge head 3, the inks of four colors of CMYK are discharged, and thereby full color printing is performed.

4. Overview of Discharge Module and Discharge Section

Figure 4:
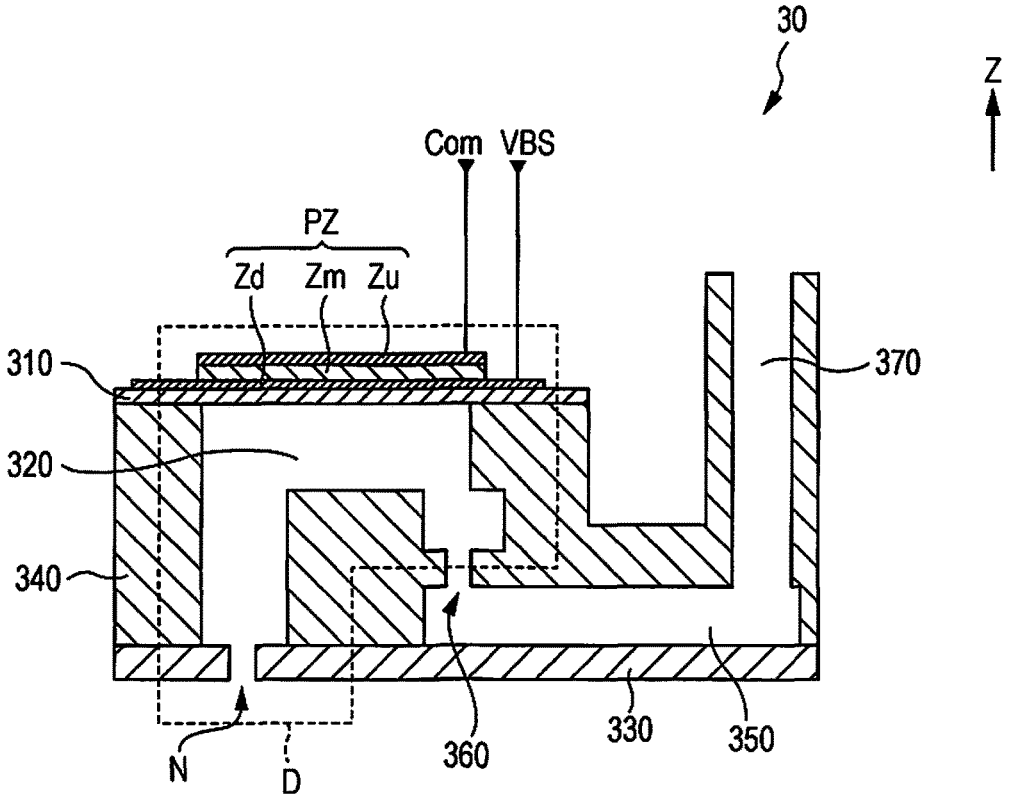
FIG. 4 is a partially sectional view schematically illustrating a discharge module in which the discharge module is cut such that a discharge section is included.
Figure 5:
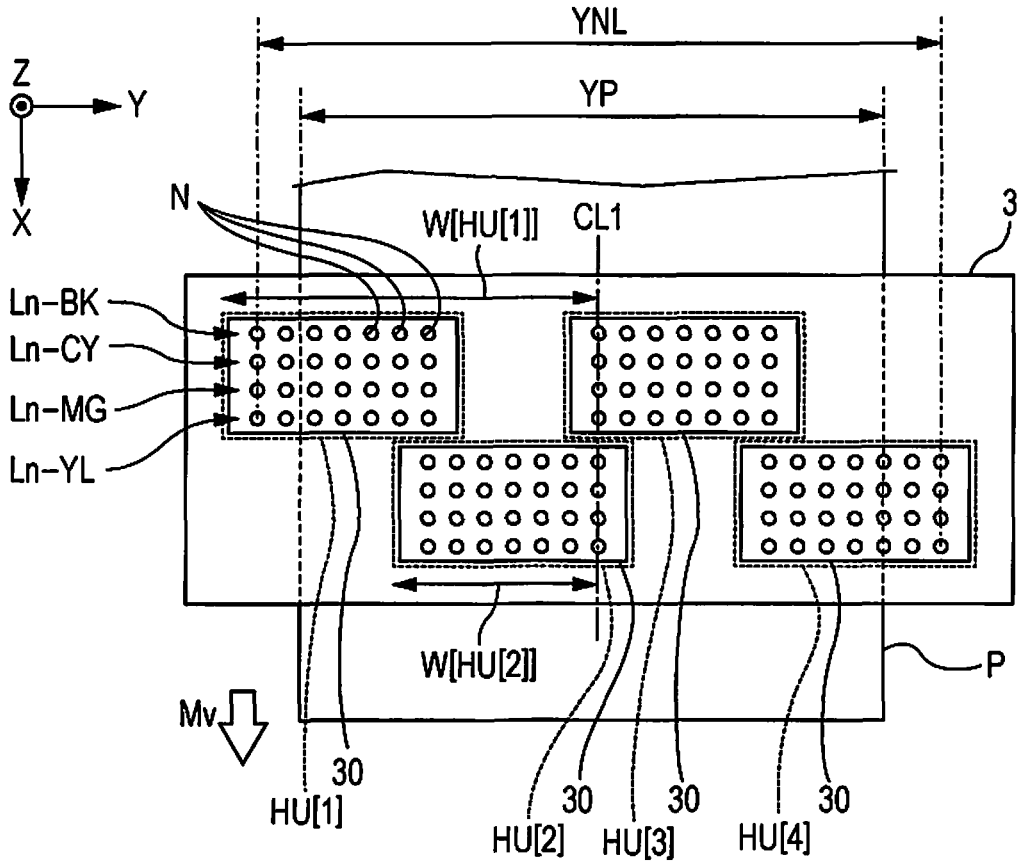
FIG. 5 illustrates an example arrangement of the four discharge modules in a liquid discharge head and 4M nozzles in the four discharge modules in the ink jet printer viewed from a +Z direction side in plan view.

With reference to FIG. 4 and FIG. 5, the discharge section D provided in the discharge module 30 will be described.

FIG. 4 is a partially sectional view schematically illustrating the discharge module 30 in which the discharge module 30 is cut such that the discharge section D is included. As illustrated in FIG. 4, the discharge section D has a piezoelectric element PZ, a cavity 320 that is filled with an ink, the nozzle N that communicates with the cavity 320, and a diaphragm 310. The cavity 320 is a space defined by a cavity plate 340, a nozzle plate 330 in which the nozzle N is formed, and the diaphragm 310. The cavity 320 communicates with a reservoir 350 via an ink supply port 360. The reservoir 350 communicates with the ink cartridge 40 that corresponds to the discharge section D via an ink inlet 370. The piezoelectric element PZ includes an upper electrode Zu, a lower electrode Zd, and a piezoelectric body Zm that is provided between the upper electrode Zu and the lower electrode Zd. The lower electrode Zd is electrically connected to a feed wire LHd (see FIG. 6) that is set to a potential VBS. When the drive signal Com is supplied to the upper electrode Zu, a voltage is applied between the upper electrode Zu and the lower electrode Zd, and thereby the piezoelectric element PZ deforms in the +Z direction or the −Z direction in accordance with the applied voltage. This embodiment uses a unimorph (monomorph) type piezoelectric element PZ as illustrated in FIG. 4. It should be noted that the piezoelectric element PZ is not limited to the unimorph type, and alternatively, a bimorph type piezoelectric element, a stacked piezoelectric element, and the like may be used. The diaphragm 310 is disposed on an upper opening of the cavity plate 340. On the diaphragm 310, the lower electrode Zd is bonded. Accordingly, when the piezoelectric element PZ is driven by the drive signal Com and deformed, the diaphragm 310 deforms. The deformation of the diaphragm 310 changes the volume of the cavity 320, and thereby the ink stored in the cavity 320 is discharged from the nozzle N. The ink in the cavity 320 that has been discharged is refilled from the reservoir 350.

FIG. 5 illustrates an example arrangement of the four discharge modules 30 in the liquid discharge head 3 and the 4M nozzles N in the four discharge modules 30 in the ink jet printer 1 viewed in the Z-axis direction from the +Z direction side in plan view. As illustrated in FIG. 5, the liquid discharge head 3 is a line head that extends in a predetermined direction. In this embodiment, it is assumed that the predetermined direction is the Y-axis direction. The four head units HU[1] to HU[4] are disposed in the order of the head unit HU[1], the head unit HU[2], the head unit HU[3], and the head unit HU[4] in the +Y direction. In other words, in this embodiment, as illustrated in FIG. 5, it is assumed that the head unit HU[2] is disposed closer to the +Y side than the head unit HU[1], the head unit HU[3] is disposed closer to the +Y side than the head unit HU[2], and the head unit HU[4] is disposed closer to the +Y side than the head unit HU[3]. Furthermore, in this embodiment, as illustrated in FIG. 5, it is assumed that the head unit HU[1] and the head unit HU[3] are disposed at the same location in the X-axis direction, and the head unit HU[2] and the head unit HU[4] are disposed at the same location in the X-axis direction. In other words, in this embodiment, the head unit HU[2] and the head unit HU[4] are disposed in the +X direction compared with the head unit HU[1] and the head unit HU[3]. Alternatively, the head units HU[1] to HU[4] may be disposed in line in the +Y direction. In other words, the four head units HU[1] to HU[4] may be disposed in the same locations in the X-axis direction.

In this embodiment, the four head units HU[1] to HU[4] are provided, however, the head units HU[1] to HU[4] do not always discharge ink at the same frequency. One of the reasons is the size variations of the recording paper P. When recording paper P of a large size (for example, A3-size paper) is used for printing, the head units HU[1] to HU[4] are used. When recording paper P of a small size (for example, A4-size paper) is used for printing, the head units HU[2] and HU[3] are used. Accordingly, compared with the head units HU[1] and HU[4], the head units HU[2] and HU[3] discharge ink more frequently. As a result, the drive circuit 20[2] that corresponds to the head unit HU[2] and the drive circuit 20[3] that corresponds to the head unit HU[3] are subject to heavier loads and generate more heat than the drive circuit 20[1] that corresponds to the head unit HU[1] and the drive circuit 20[4] that corresponds to the head unit HU[4].

Accordingly, in this embodiment, the drive circuits 20[2] and 20[3] that generate more heat than the drive circuits 20[1] and 20[4] are disposed near the inlet 91 (see FIG. 2). Since the drive circuits 20[2] and 20[3], which generate more heat, are disposed on the upstream side of the air flow that is flowing from the inlet 91 toward the outlet 92, the drive circuits 20[2] and 20[3], which generate more heat, can be effectively cooled. Consequently, failures such as image quality decrease and a drive circuit failure due to the heat generated in the drive circuit 20[q] can be reduced.

In the following description, it is assumed that the frequency of use (specifically, the frequency of ink discharge) of the head unit HU[1] and the frequency of use of the head unit HU[4] are substantially the same and the frequency of use of the head unit HU[2] and the frequency of use of the head unit HU[3] are substantially the same. Furthermore, it is assumed that the frequency of use of the head units HU[2] and HU[3] is higher than the frequency of use of the head units HU[1] and HU[4]. In other words, it is assumed that the head unit HU[q] closer to a central section CL1 of the line head is more frequently used. The central section CL1 is a virtual straight line that divides the liquid discharge head 3 in the Y-axis direction into two equal parts.

In the following description, a distance between the central section CL1 and a head unit HU[q] in the liquid discharge head 3 is expressed as a distance W[HU[q]]. A distance W[HU[2]] between the central section CL1 and the head unit HU[2] is shorter than a distance W[HU[1]] between the central section CL1 and the head unit HU[1]. A distance W[HU[3]] (not illustrated) between the central section CL1 and the head unit HU[3] is shorter than a distance W[HU[4]] (not illustrated) between the central section CL1 and the head unit HU[4].

In this embodiment, a distance W[HU[q]] is a distance between the central section CL1 and the head unit HU[q] that is farthest from the central section CL1 in the Y-axis direction. Alternatively, the distance W[HU[q]] may be a distance between the central section CL1 and the center of gravity of the head unit HU[q] or the shortest distance between the central section CL1 and the head unit HU[q].

Each discharge module 30 in the liquid discharge head 3 has nozzle arrays Ln. The nozzle array Ln includes a plurality of nozzles N that are arranged in a line so as to extend in a predetermined direction. In this embodiment, as an example, it is assumed that each discharge module 30 has four nozzle arrays Ln including a nozzle array Ln-BK, a nozzle array Ln-CY, a nozzle array Ln-MG, and a nozzle array Ln-YL. The nozzles N in the nozzle array Ln-BK are provided in the discharge section D that discharges a black ink, the nozzles N in the nozzle array Ln-CY are provided in the discharge section D that discharges a cyan ink, the nozzles N in the nozzle array Ln-MG are provided in the discharge section D that discharges a magenta ink, and the nozzles N in the nozzle array Ln-YL are provided in the discharge section D that discharges a yellow ink. Furthermore, in this embodiment, as an example, it is assumed that each of the four nozzle arrays Ln in each discharge module 30 extends in the Y-axis direction in plan view.

As illustrated in FIG. 5, a range YNL of the 4M nozzles N in the liquid discharge head 3 in the Y-axis direction covers a range YP of the recording paper P in the Y-axis direction when the ink jet printer 1 performs print processing onto the recording paper P (to be exact, the recording paper P that has a maximum width that is a maximum width in which the ink jet printer 1 can print in the Y-axis direction).

It should be noted that the arrangement of the four discharge modules 30 in the liquid discharge head 3 and the arrangement of the nozzle arrays Ln in each discharge module 30 illustrated in FIG. 5 are only examples. In each liquid discharge head 3, the discharge modules 30 and the nozzle arrays Ln may be provided in any arrangement. For example, in FIG. 5, the nozzle arrays Ln extend in the Y-axis direction; alternatively, the nozzle arrays Ln may be provided so as to extend in a predetermined direction within the XY plane. For example, the nozzle arrays Ln may be provided so as to extend in a direction different from the Y-axis direction and the X-axis direction, such as an oblique direction in FIG. 5. Furthermore, in FIG. 5, the four nozzle arrays Ln are provided in each discharge module 30; alternatively, one or more nozzle arrays Ln may be provided in each discharge module 30. Furthermore, in FIG. 5, the plurality of nozzles N constituting each nozzle array Ln are arranged in a line in the Y-axis direction. Alternatively, in FIG. 5, positions of the even-numbered nozzles N and the odd-numbered nozzles N from the −Y side may be different from each other in the X-axis direction, that is, the nozzles N may be provided in a so-called staggered arrangement.

5. Configuration of Head Unit

Hereinafter, a configuration of each head unit HU[q] will be described with reference to FIG. 6.

Figure 6:
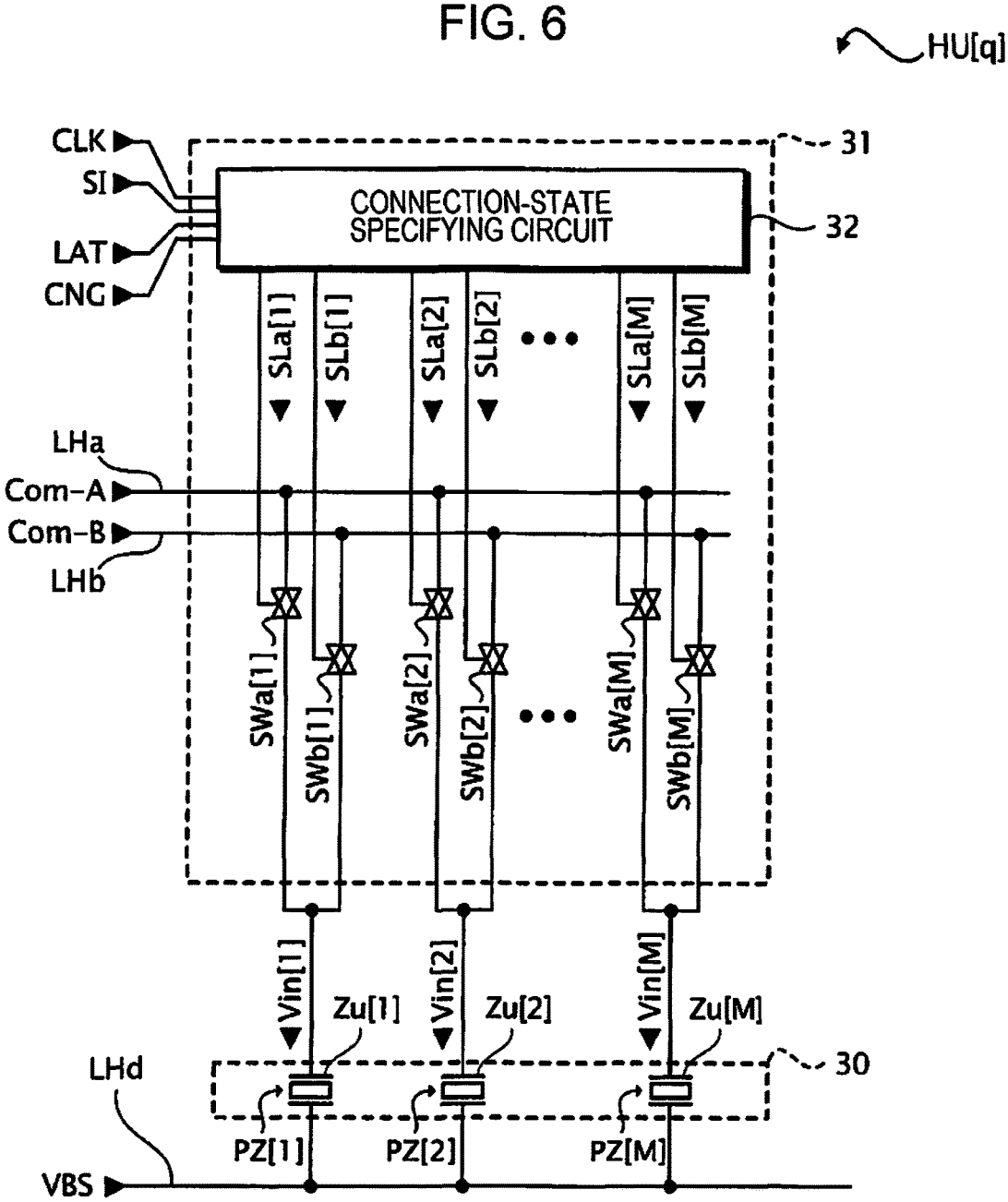
FIG. 6 is a block diagram illustrating a configuration of a head unit.

FIG. 6 is a block diagram illustrating a configuration of the head unit HU[q]. As described above, the head unit HU[q] includes the discharge module 30 and the drive signal supply circuit 31. The head unit HU[q] also includes an internal wire LHa to which the drive waveform signal Com-A is supplied from the drive-signal generation module 2, an internal wire LHb to which the drive waveform signal Com-B is supplied from the drive-signal generation module 2, and a feed wire LHd that is set at a potential VBS.

As illustrated in FIG. 6, the drive signal supply circuit 31 includes M switches SWa (SWa[1] to SWa[M]), M switches SWb (SWb[1] to SWb[M]), and a connection-state designating circuit 32 for designating a connection state of each switch. Each switch may be, for example, a transmission gate. The connection-state designating circuit 32 generates connection-state designating signals SLa[1] to SLa[M] for designating on or off of the switches SWa[1] to SWa[M], and connection-state designating signals SLb[1] to SLb[M] for designating on or off of the switches SWb[1] to SWb[M] in accordance with the print signal SI that is supplied from the controller 6, a latch signal LAT, and a change signal CNG. The switch SWa[m] switches between conduction and non-conduction between the internal wire LHa and the upper electrode Zu[m] of the piezoelectric element PZ[m], which is provided in the discharge section D[m], in accordance with the connection-state designating signal SLa[m]. In this embodiment, as an example, it is assumed that the switch SLa[m] is turned on when the connection-state designating signal SLa[m] is at a high level and is turned off at a low level. The switch SWb[m] switches between conduction and non-conduction between the internal wire LHb and the upper electrode Zu[m] of the piezoelectric element PZ[m], which is provided in the discharge section D[m], in accordance with the connection-state designating signal SLb[m]. In this embodiment, as an example, it is assumed that the switch SWb[m] is turned on when the connection-state designating signal SLb[m] is at a high level and is turned off at a low level. In the drive waveform signals Com-A and Com-B, a signal that is actually supplied to the piezoelectric element PZ[m] in the discharge section D[m] via the switch SWa[m] or SWb[m] may be referred to as a supply-drive signal Vin[m].

6. Operation of Head Unit

Hereinafter, operations of each head unit HU[q] will be described with reference to FIGS. 7 to 8.

In this embodiment, an operation period of the ink jet printer 1 includes one or more unit periods Tu. In each unit period Tu, the ink jet printer 1 can perform print processing. Strictly, in each unit period Tu, in the print processing, the ink jet printer 1 can perform a process of driving each discharge section D to discharge the ink from the discharge section D. The ink jet printer 1 repeatedly performs the print processing over a plurality of continuous or intermittent unit periods Tu to discharge the ink from each discharge section D one or more times, and thereby an image represented by the print data Img is formed.

Figures 7, 8:
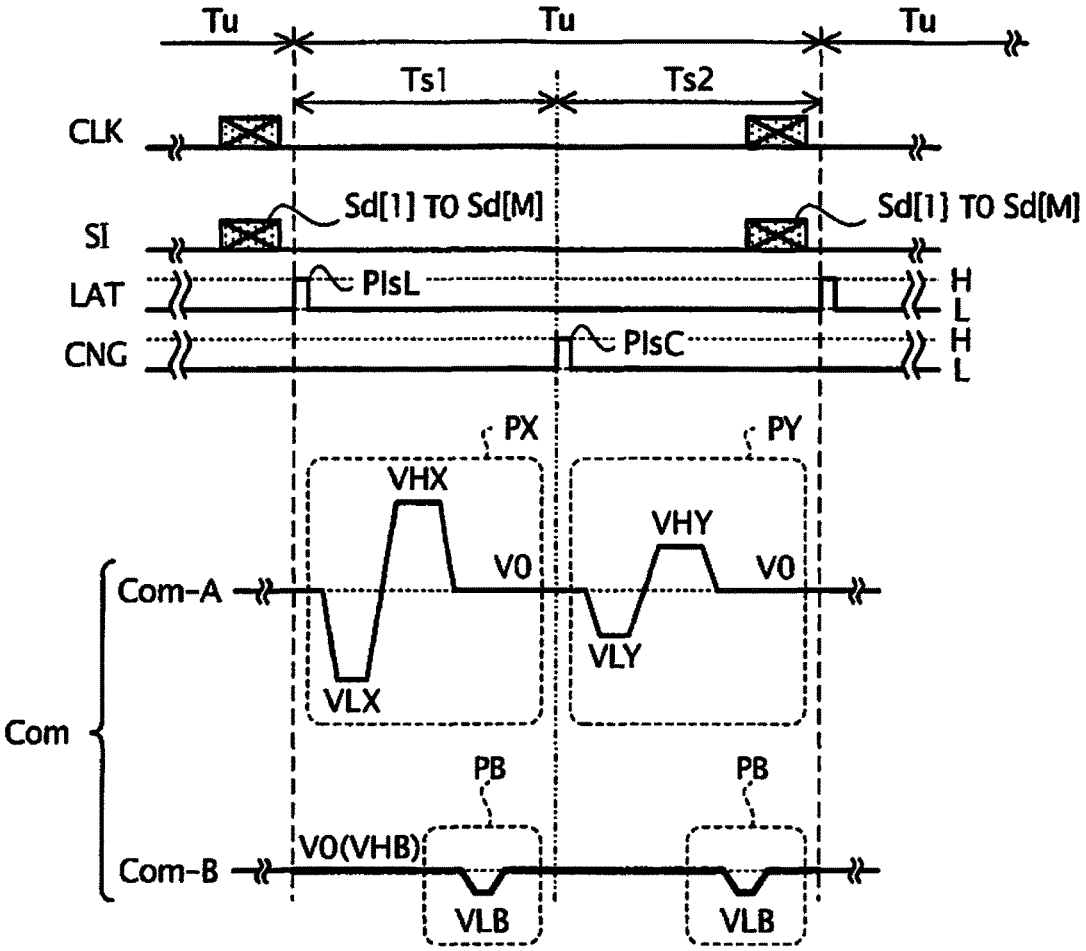
FIG. 7 is a timing chart of operations of the ink jet printer in a unit period.
FIG. 8 illustrates an example of a relationship among an individual-designating signal and connection-state designating signals.

FIG. 7 is a timing chart of operations of the ink jet printer 1 in a unit period Tu. As illustrated in FIG. 7, the controller 6 outputs the latch signal LAT that has a pulse PlsL and the change signal CNG that has a pulse PlsC. With these signals, the controller 6 defines a unit period Tu as the period from the rise of the pulse PlsL to the rise of the next pulse PlsL. The controller 6 divides the unit period Tu into a control period Ts1 and a control period Ts2 by the pulse PlsC. The print signal SI includes individual-designating signals Sd[1] to Sd[M] for designating driving modes of the discharge section D[1] to D[M] in each unit period Tu. When a print process is performed during the unit period Tu, prior to the start of the unit period Tu, the controller 6 supplies the print signal SI, which includes the individual-designating signals Sd[1] to Sd[M], to the connection-state designating circuit 32 in synchronization with the clock signal CLK as illustrated in FIG. 7. In this process, in the unit period Tu, the connection-state designating circuit 32 generates connection-state designating signals SLa[m] and SLb[m] in accordance with the individual-designating signal Sd[m].

As illustrated in FIG. 7, the generation circuit 20-A[q] outputs the drive waveform signal Com-A for driving the head unit HU[q]. The drive waveform signal Com-A includes a waveform PX that is supplied in the control period Ts1 and a waveform PY that is supplied in the control period Ts2. In this embodiment, the waveform PX and the waveform PY are determined such that the potential difference between a maximum potential VHX and a minimum potential VLX of the waveform PX is larger than the potential difference between a maximum potential VHY and a minimum potential VLY of the waveform PY. Specifically, to drive the discharge section D[m] by the drive waveform signal Com-a having the waveform PX, the waveform of the waveform PX is determined such that the ink of an amount (medium amount) corresponding to a medium dot is discharged from the discharge section D[m]. Similarly, to drive the discharge section DM by the drive waveform signal Com-A having the waveform PY, the waveform of the waveform PY is determined such that the ink of an amount (small amount) corresponding to a small dot is discharged from the discharge section D[m]. The potentials of the waveform PX and the waveform PY at the start and at the end are set to a reference potential V0. The generation circuit 20-B[q] outputs the drive waveform signal Com-B for driving the head unit HU[q]. The drive waveform signal Com-B has two waveforms PBs that are supplied in the control periods Ts1 and Ts2 respectively. In this embodiment, the waveform PB is determined such that the potential difference between a maximum potential VHB and a minimum potential VLB of the waveform PB is smaller than the potential difference between the maximum potential VHY and the minimum potential VLY of the waveform PY. Specifically, to drive the discharge section D[m] by the drive waveform signal Com-B having the waveform PB, the waveform of the waveform PB is determined such that the discharge section D[m] is driven so as not to discharge the ink. The potentials of the waveform PB at the start and at the end are set to the reference potential V0. In this embodiment, it is assumed that the maximum potential VHB is the reference potential V0. As illustrated in FIG. 7, in this embodiment, the amplitude of the drive waveform signal Com-A is larger than the amplitude of the drive waveform signal Com-B.

FIG. 8 illustrates an example of a relationship among the individual-designating signal Sd[m] and the connection-state designating signals SLa[m] and SLb[m]. As illustrated in FIG. 8, in this embodiment, it is assumed that the individual-designating signal Sd[m] is a 2-bit digital signal. Specifically, in each unit period Tu, to the discharge section D[m], the individual-designating signal Sd[m] is set to one of four values: a value (1, 1) that designates a discharge (may be referred to as a "formation of a large dot") of the ink of an amount (a large amount) corresponding to a large dot: a value (1, 0) that designates a discharge (may be referred to as a "formation of a medium dot") of the ink of a medium amount: a value (0, 1) that designates a discharge (may be referred to as a "formation of a small dot") of the ink of a small amount; and a value (0, 0) that designates a non-discharge of the ink.

When the individual-designating signal Sd[m] is set to the value (1, 1), which designates the formation of a large dot, the connection-state designating circuit 32 sets the connection-state designating signal SLa[m] to a high level in the control periods Ts1 and Ts2, and sets the connection-state designating signal SLb(m) to a low level in the control periods Ts1 and Ts2. In this case, in the control period Ts1, the discharge section D[m] is driven by the drive waveform signal Com-A having the waveform PX and discharges the middle amount of ink, and in the control period Ts2, the discharge section DM is driven by the drive waveform signal Com-A having the waveform PY and discharges the small amount of ink. By these operations, the discharge section D[m] discharges the large amount of ink in total in the unit period Tu, and thereby the large dot is formed on the recording paper P. When the individual-designating signal Sd[m] is set to the value (1, 0), which designates the formation of a medium dot, the connection-state designating circuit 32 sets the connection-state designating signal SLa [m] to the high level in the control period Ts1 and sets to the low level in the control period Ts2, respectively, and sets the connection-state designating signal SLb[m] to the low level in the control period Ts1 and sets to the high level in the control period Ts2, respectively. In this case, the discharge section D[m] discharges the medium amount of ink in the unit period Tu, and thereby the medium dot is formed on the recording paper P. When the individual-designating signal Sd[m] is set to the value (0, 1), which designates the formation of a small dot, the connection-state designating circuit 32 sets the connection-state designating signal SLa [m] to the low level in the control period Ts1 and sets to the high level in the control period Ts2, respectively, and sets the connection-state designating signal SLb[m] to the high level in the control period Ts1 and sets to the low level in the control period Ts2, respectively. In this case, the discharge section D[m] discharges the small amount of ink in the unit period Tu, and thereby the small dot is formed on the recording paper P. When the individual-designating signal Sd[m] is set to the value (0, 0), which designates the non-discharge of ink, the connection-state designating circuit 32 sets the connection-state designating signal SLa[m] to the low level in the control periods Ts1 and Ts2, and sets the connection-state designating signal SLb[m] to the high level in the control periods Ts1 and Ts2. In this case, the discharge section D[m] discharges no ink in the unit period Tu, and thereby no dot is formed on the recording paper P.

7. Arrangement of Drive Circuit

Figure 9:
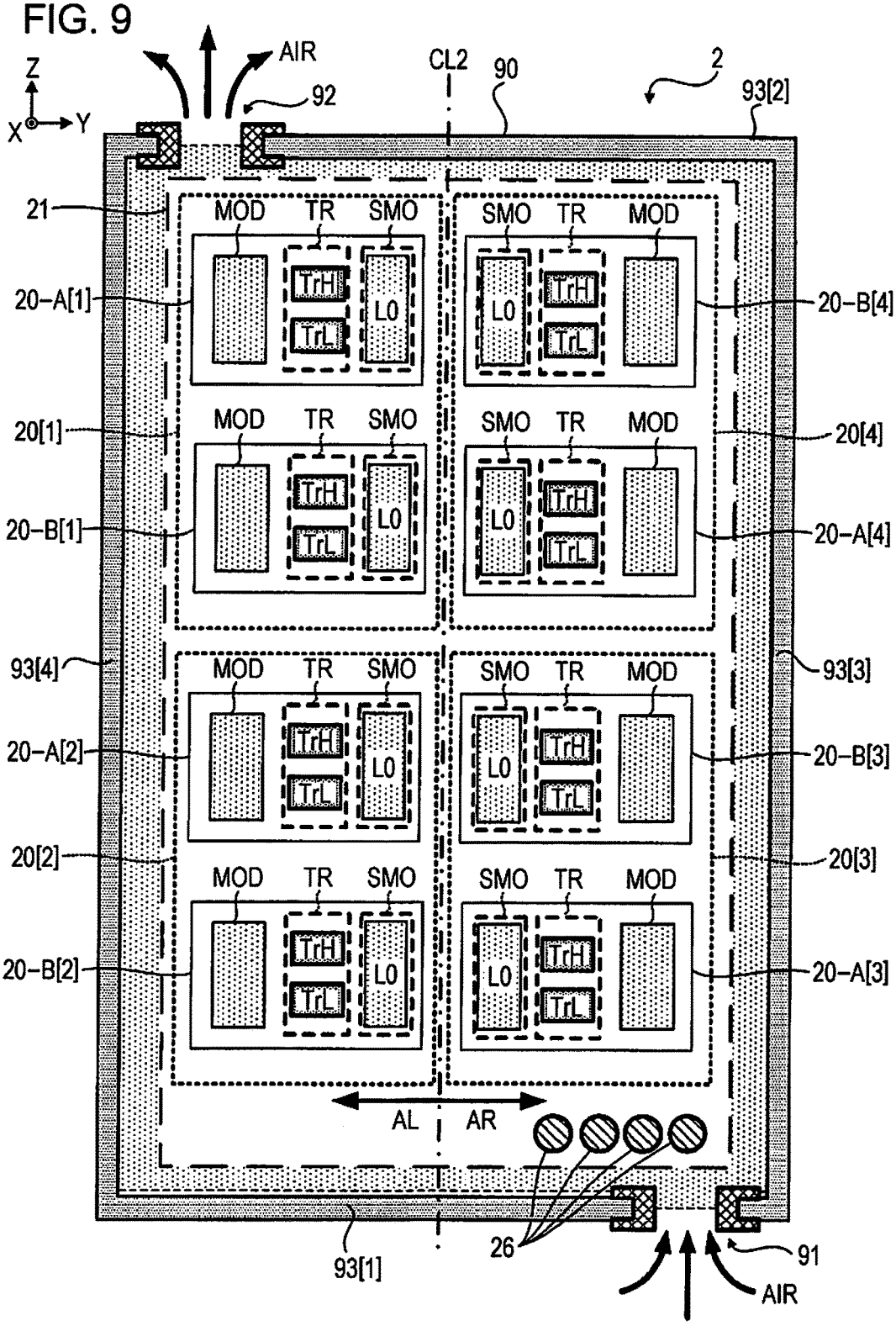
FIG. 9 illustrates an arrangement of generation circuits in a shielding case viewed from a +X direction in plan view.
Figure 10:
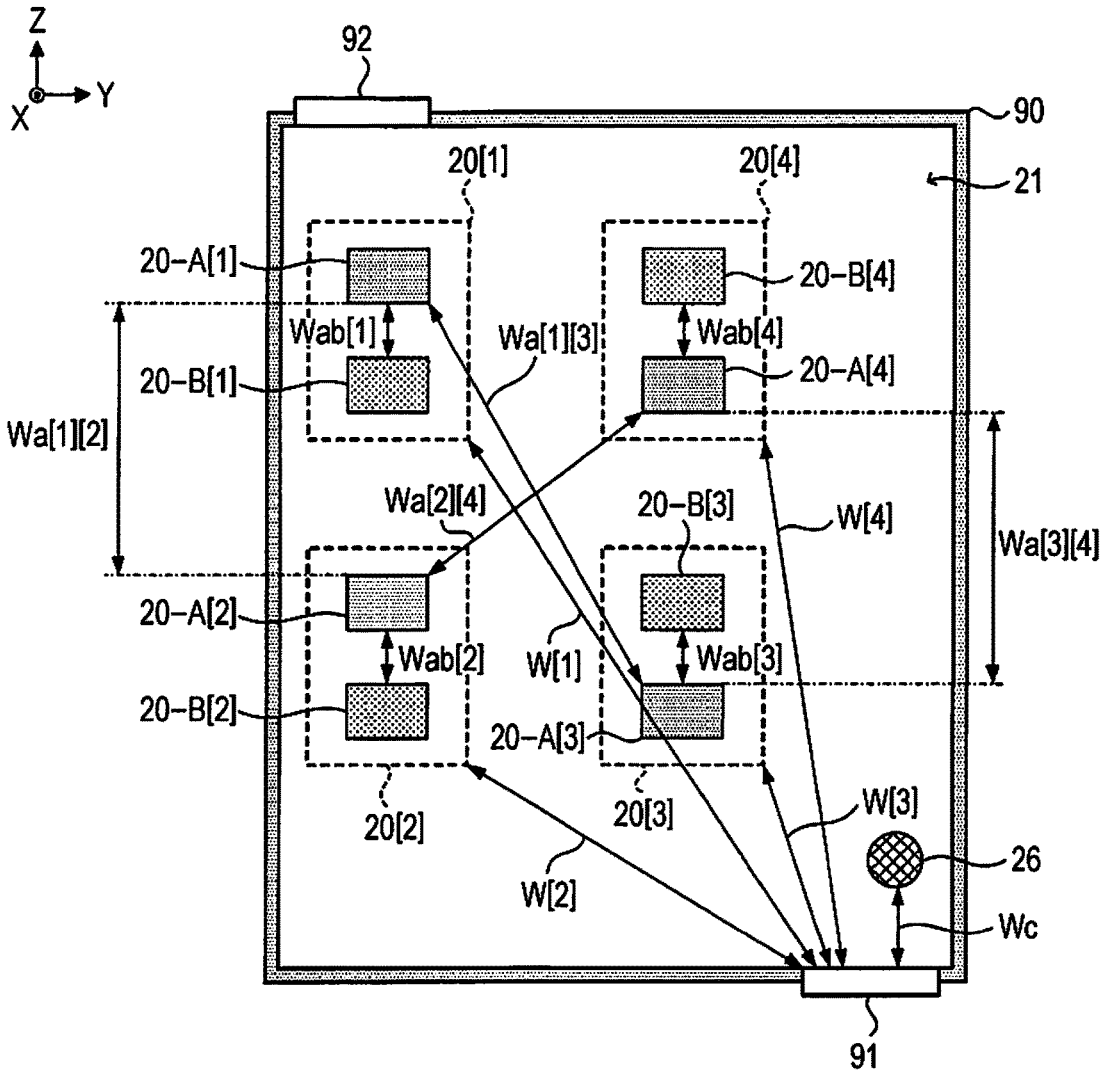
FIG. 10 illustrates an arrangement of eight generation circuits illustrated in FIG. 9 with the concept of distance.

With reference to FIG. 9 and FIG. 10, an arrangement of the generation circuit 20-P[q] will be described.

FIG. 9 illustrates an arrangement of the generation circuits 20-P[q] in the shielding case 90 viewed from the +X direction in plan view. Before the following detailed description, with reference to FIG. 9, an arrangement of the generation circuit 20-A[q], which generates the drive waveform signal Com-A, and arrangement of the generation circuit 20-B[q], which generates the drive waveform signal Com-B, will be described.

1. Configuration of the Generation Circuit 20-A[q]

The generation circuit 20-A[q] includes a modulating section MOD, an amplifying section TR that has two transistors TrH and TrL, and smoothing section SMO that has a coil L0. The modulating section MOD performs pulse modulation on a waveform-designating signal for designating a waveform of the drive waveform signal Com-A to generate a modulation signal. The amplifying section TR amplifies the modulation signal to generate an amplified signal using the two transistors TrH and TrL. The smoothing section SMO smooths the amplified signal to generate a drive waveform signal Com-A using the coil L0. The amplifying section TR generates the largest amount of heat among the electronic components constituting the generation circuit 20-A[q]. The smoothing section SMO generates the second largest amount of heat among the electric components. The modulating section MOD generates a smaller amount of heat than the amplifying section TR and the smoothing section SMO.

2. Configuration of the Generation Circuit 20-B[q]

The generation circuit 20-B[q] includes the modulating section MOD, the amplifying section TR that has two transistors TrH and TrL, and the smoothing section SMO that has the coil L0. The modulating section MOD performs pulse modulation on a waveform-designating signal for designating a waveform of the drive waveform signal Com-B to generate a modulation signal. The amplifying section TR amplifies the modulation signal to generate an amplified signal using the two transistors TrH and TrL. The smoothing section SMO smooths the amplified signal to generate the drive waveform signal Com-B using the coil L0. The amplifying section TR generates the largest amount of heat among the electronic components constituting the generation circuit 20-B[q]. The smoothing section SMO generates the second largest amount of heat among the electric components. The modulating section MOD generates a smaller amount of heat than the amplifying section TR and the smoothing section SMO.

As described above, the configuration of the generation circuit 20-A[q] is the same as that of the generation circuit 20-B[q]. However, as described with reference to FIG. 7, the amplitude of the drive waveform signal Com-A that is generated by the generation circuit 20-A[q] is larger than the amplitude of the drive waveform signal Com-B that is generated by the generation circuit 20-B[q]. Accordingly, even if the circuit configurations are the same, the amount of heat generated by the generation circuit 20-A[q] is larger than that by the generation circuit 20-B[q].

As described above, it is assumed that the frequency of use of the head units HU[2] and HU[3] is higher than the frequency of use of the head units HU[1] and HU[4]. Consequently, the amount of heat generated by the generation circuit 20-A[2] is larger than that by the generation circuit 20-A[1]. Similarly, the amount of heat generated by the generation circuit 20-A[3] is larger than that by the generation circuit 20-A[4].

3. Arrangement of Drive Circuit

In the example illustrated in FIG. 9, a region of the circuit board 21 is equally divided in the Y-axis direction by a central line CL2. In the following description, a region of the circuit board 21 on the −Y side from the central line CL2 is referred to as a "region AL". A region of the circuit board 21 on the +Y side from the central line CL2 is referred to as a "region AR".

In the region AL, the drive circuit 20[1] and the drive circuit 20[2] are disposed. The drive circuit 20[2], which generates a larger amount of heat than the drive circuit 20[1], is disposed closer to the −Z side than the drive circuit 20[1]. Focusing on the drive circuit 20[1], the generation circuit 20-A[1], which generates the drive waveform signal Com-A, is disposed closer to the −Z side than the generation circuit 20-B[1], which generates the drive waveform signal Com-B. Focusing on the drive circuit 20[2], the generation circuit 20-A[2], which generates the drive waveform signal Com-A, is disposed closer to the +Z side than the generation circuit 20-B[2], which generates the drive waveform signal Com-B.

In the region AR, the drive circuit 20[3] and the drive circuit 20[4] are disposed. The drive circuit 20[3], which generates a larger amount of heat than the drive circuit 20[4], is disposed closer to the −Z side than the drive circuit 20[4]. Focusing on the drive circuit 20[3], the generation circuit 20-A[3], which generates the drive waveform signal Com-A, is disposed closer to the −Z side than the generation circuit 20-B[3], which generates the drive waveform signal Com-B. Focusing on the drive circuit 20[4], the generation circuit 20-A[4], which generates the drive waveform signal Com-A, is disposed closer to the −Z side than the generation circuit 20-B[4], which generates the drive waveform signal Com-B.

In this embodiment, the positions of the electrical components (the modulating sections MOD, the amplifying sections TR, and the smoothing sections SMO) of the generation circuits 20-P[q] that are arranged in the region AL and the positions of the electrical components (the modulating sections MOD, the amplifying sections TR, and the smoothing sections SMO) of the generation circuits 20-P[q] that are arranged in the region AR are symmetric with respect to the central line CL2. The smoothing section SMO, which generates more heat than the modulating section MOD, is disposed near the central line CL2. The amplifying section TR, which generates the largest amount of heat, is disposed between the modulating section MOD and the smoothing section SMO. In other words, the distance between the smoothing section SMO and the central line CL2 is shorter than the distance between the amplifying section TR and the central line CL2. Furthermore, the distance between the amplifying section TR and the central line CL2 is shorter than the distance between the modulating section MOD and the central line CL2.

As described above, the generation circuits 20-A[q], which generate the drive waveform signals Com-A, and the generation circuits 20-B[q], which generate the drive waveform signals Com-B, are alternately disposed (referred to as an "arrangement A"). Furthermore, the amplifying sections TR and the smoothing sections SMO, which generate more heat than the modulating sections MOD, are disposed near the central line CL2 so as to be located on the flow path of air flowing from the inlet 91 to the outlet 92 (referred to as an "arrangement B"). The arrangement A and arrangement B can prevent possible failure of the circuit board 21 due to the heat sources concentrated in one area and can efficiently cool the drive circuits by concentrating the heat sources on the air flow path.

4. Capacitors for Power Supply

In the example illustrated in FIG. 9, four capacitors 26 for power supply are provided on the circuit board 21. Each of the capacitors 26 for power supply is a bypass capacitor for reducing fluctuations in supply voltage Vh of a power supply circuit 25 (see FIG. 11 described below). In this embodiment, one capacitor 26 for power supply is provided for each of the four drive circuits 20[1] to 20[4]. The four capacitors 26 for power supply enable stable power supply to the respective four drive circuits 20[1] to 20[4]. The number of the capacitors 26 for power supply may be any number. For example, in consideration of capacitance, one capacitor 26 for power supply may be provided for the four drive circuits 20[1] to 20[4].

In this embodiment, each of the four capacitors 26 for power supply is an electrolyte capacitor. Generally, the electrolyte capacitor is sensitive to heat. The performance of the electrolyte capacitor significantly decreases when the electrolyte capacitor is continuously exposed to heat exceeding its heat resistant temperature. In order to protect the electrolyte capacitors from the influence of heat, the four capacitors 26 for power supply are disposed between the inlet 91 and the outlet 92. In the example in FIG. 9, the four capacitors 26 for power supply are disposed near the inlet 91. This arrangement enables the four capacitors 26 for power supply to be effectively cooled. Accordingly, stable power can be supplied to each of the four drive circuits 20[1] to 20[4].

FIG. 10 illustrates an arrangement of the eight generation circuits 20-P[q] illustrated in FIG. 9 with the concept of distance.

A. Distance Among Drive Circuits and Inlet

If a distance between a drive circuit 20[q] and the inlet 91 is expressed as a distance W[q], the following distance relationships A1 to A4 hold, wherein the variable q is a natural number that satisfies $1 \leq q \leq 4$:

A1. A distance W[3] between the drive circuit 20[3] and the inlet 91 is shorter than a distance W[4] between the drive circuit 20[4] and the inlet 91.

A2. A distance W[3] between the drive circuit 20[3] and the inlet 91 is shorter than a distance W[1] between the drive circuit 20[1] and the inlet 91.

A3. A distance W[2] between the drive circuit 20[2] and the inlet 91 is shorter than a distance W[1] between the drive circuit 20[1] and the inlet 91.

A4. A distance W[2] between the drive circuit 20[2] and the inlet 91 is shorter than a distance W[4] between the drive circuit 20[4] and the inlet 91.

In this embodiment, the distance W[q] may be the shortest distance between the drive circuit 20[q] and the inlet 91, or a distance between a central section of the drive circuit 20[q] and a central section of the inlet 91.

With respect to the distance relationship A1, the head unit HU[3] corresponds to a "first head unit", and the head unit HU[4] corresponds to a "second head unit". The drive circuit 20[3] that drives the head unit HU[3] corresponds to a "first drive circuit", and the drive circuit 20[4] that drives the head unit HU[4] corresponds to a "second drive circuit". With respect to the distance relationship A2, the head unit HU[3] corresponds to a "first head unit", and the head unit HU[1] corresponds to a "second head unit". The drive circuit 20[3] that drives the head unit HU[3] corresponds to the "first drive circuit", and the drive circuit 20[1] that drives the head unit HU[1] corresponds to the "second drive circuit". With respect to the distance relationship A3, the head unit HU[2] corresponds to the "first head unit", and the head unit HU[1] corresponds to the "second head unit". The drive circuit 20[2] that drives the head unit HU[2] corresponds to the "first drive circuit", and the drive circuit 20[1] that drives the head unit HU[1] corresponds to the "second drive circuit". With respect to the distance relationship A4, the head unit HU[2] corresponds to the "first head unit", and the head unit HU[4] corresponds to the "second head unit". The drive circuit 20[2] that drives the head unit HU[2] corresponds to the "first drive circuit", and the drive circuit 20[4] that drives the head unit HU[4] corresponds to the "second drive circuit".

B. Distance between Two Generation Circuits

A distance between a generation circuit 20-A[q] that is provided in a drive circuit 20[q] and a generation circuit 20-B[q] that is provided in the drive circuit 20[q] is expressed as a distance Wab[q]. Furthermore, if a distance between a generation circuit 20-A[q1] that is provided in a drive circuit 20[q1] and a generation circuit 20-A[q2] that is provided in a drive circuit 20[q2] is expressed as a distance Wa[q1][q2], the following distance relationships B1 to B4 hold, wherein the variable q1 is a natural number that satisfies $1 \leq q1 \leq 4$, the variable q2 is a natural number that satisfies $1 \leq q2 \leq 4$, and the variable q1 is different from the variable q2 ($q1 \neq q2$):

B1. A distance Wab[3] between the generation circuit 20-A[3] and the generation circuit 20-B[3] is shorter than a distance Wa[3][4] between the generation circuit 20-A[3] and the generation circuit 20-A[4].

B2. A distance Wab[3] between the generation circuit 20-A[3] and the generation circuit 20-B[3] is shorter than a distance Wa[1][3] between the generation circuit 20-A[3] and the generation circuit 20-A[1].

B3. A distance Wab[2] between the generation circuit 20-A[2] and the generation circuit 20-8[2] is shorter than a distance Wa[1][2] between the generation circuit 20-A[2] and the generation circuit 20-A[1].

B4. A distance Wab[2] between the generation circuit 20-A[2] and the generation circuit 20-8[2] is shorter than a distance Wa[2][4] between the generation circuit 20-A[2] and the generation circuit 20-A[4].

In this embodiment, the distance Wab[q] is the shortest distance between the generation circuit 20-A[q] and the generation circuit 20-B[q]. Alternatively, the distance Wab [q] may be a distance between a central section of the generation circuit 20-A[q] and a central section of the generation circuit 20-B[q]. In this embodiment, the distance Wa[q1][q2] is the shortest distance between the generation circuit 20-A[q1] and the generation circuit 20-A[q2]. Alternatively, the distance Wa[q1][q2] may be a distance between a central section of the generation circuit 20-A[q1] and a central section of the generation circuit 20-A[q2].

With respect to the distance relationship B1, the generation circuit 20-A[3] that generates the drive waveform signal Com-A corresponds to a "first generation circuit that generates a first drive waveform signal". The generation circuit 20-B[3] that generates the drive waveform signal Com-B corresponds to a "second generation circuit that generates a second drive waveform signal". The generation circuit 20-A [4] that generates the drive waveform signal Com-A corresponds to a "third generation circuit that generates a third drive waveform signal". The generation circuit 20-B[4] that generates the drive waveform signal Com-B corresponds to a "fourth generation circuit that generates a fourth drive waveform signal".

With respect to the distance relationship B2, the generation circuit 20-A[3] that generates the drive waveform signal Com-A corresponds to a "first generation circuit that generates a first drive waveform signal". The generation circuit 20-B[3] that generates the drive waveform signal Com-B corresponds to a "second generation circuit that generates a second drive waveform signal". The generation circuit 20-A [1] that generates the drive waveform signal Com-A corresponds to a "third generation circuit that generates a third drive waveform signal". The generation circuit 20-B[1] that generates the drive waveform signal Com-B corresponds to a "fourth generation circuit that generates a fourth drive waveform signal".

With respect to the distance relationship B3, the generation circuit 20-A[2] that generates the drive waveform signal Com-A corresponds to the "first generation circuit that generates a first drive waveform signal". The generation circuit 20-B[2] that generates the drive waveform signal Com-B corresponds to the "second generation circuit that generates a second drive waveform signal". The generation circuit 20-A[1] that generates the drive waveform signal Com-A corresponds to the "third generation circuit that generates a third drive waveform signal". The generation circuit 20-B[1] that generates the drive waveform signal Com-B corresponds to the "fourth generation circuit that generates a fourth drive waveform signal".

With respect to the distance relationship B4, the generation circuit 20-A[2] that generates the drive waveform signal Com-A corresponds to the "first generation circuit that generates a first drive waveform signal". The generation circuit 20-B[2] that generates the drive waveform signal Com-B corresponds to the "second generation circuit that generates a second drive waveform signal". The generation circuit 20-A[4] that generates the drive waveform signal Com-A corresponds to the "third generation circuit that generates a third drive waveform signal". The generation circuit 20-B[4] that generates the drive waveform signal Com-B corresponds to the "fourth generation circuit that generates a fourth drive waveform signal".

Furthermore, the following distance relationships B5 and B6 hold:

B5. A distance Wab[4] between the generation circuit 20-A[4] and the generation circuit 20-B[4] is shorter than a distance Wa[3][4] between the generation circuit 20-A[4] and the generation circuit 20-A[3].

B6. A distance Wab[1] between the generation circuit 20-A[1] and the generation circuit 20-B[1] is shorter than a distance Wa[1][2] between the generation circuit 20-A[1] and the generation circuit 20-A[2].

With respect to the distance relationship B5, the generation circuit 20-A[3] that generates the drive waveform signal Com-A corresponds to the "first generation circuit that generates a first drive waveform signal". The generation circuit 20-B[3] that generates the drive waveform signal Com-B corresponds to the "second generation circuit that generates a second drive waveform signal". The generation circuit 20-A[4] that generates the drive waveform signal Com-A corresponds to the "third generation circuit that generates a third drive waveform signal". The generation circuit 20-B[4] that generates the drive waveform signal Com-B corresponds to the "fourth generation circuit that generates a fourth drive waveform signal".

With respect to the distance relationship B6, the generation circuit 20-A[2] that generates the drive waveform signal Com-A corresponds to the "first generation circuit that generates a first drive waveform signal". The generation circuit 20-B[2] that generates the drive waveform signal Com-B corresponds to the "second generation circuit that generates a second drive waveform signal". The generation circuit 20-A[1] that generates the drive waveform signal Com-A corresponds to the "third generation circuit that generates a third drive waveform signal". The generation circuit 20-B[1] that generates the drive waveform signal Com-B corresponds to the "fourth generation circuit that generates a fourth drive waveform signal".

A distance WC between one of the four capacitors 26 for power supply and the inlet 91 is shorter than the distances W[1] to W[4] illustrated in FIG. 10. Although not illustrated, a distance between the generation circuit 20-A[3] and the inlet 91 is shorter than a distance between the generation circuit 20-A[1] and the inlet 91 and shorter than a distance between the generation circuit 20-A[4] and the inlet 91. A distance between the generation circuit 20-A[2] and the inlet 91 is shorter than a distance between the generation circuit 20-A[1] and the inlet 91 and shorter than a distance between the generation circuit 20-A[4] and the inlet 91.

In the description of FIG. 9, a distance between the amplifying section TR and the central line CL2 is shorter than a distance between the modulating section MOD and the central line CL2. This can also be expressed as follows, taking two generation circuits that are symmetric with respect to the central line CL2, for example, the generation circuit 20-A[3] and the generation circuit 20-B[2]: A distance between the amplifying section TR of the generation circuit 20-A[3] and the amplifying section TR of the generation circuit 20-B[2] is shorter than a distance between the modulating section MOD of the generation circuit 20-A[3] and the modulating section MOD of the generation circuit 20-B[2].

In the description of FIG. 9, a distance between the smoothing section SMO and the central line CL2 is shorter than a distance between the amplifying section TR and the central line CL2. This can also be expressed as follows, taking two generation circuits that are symmetric with respect to the central line CL2, for example, the generation circuit 20-A[3] and the generation circuit 20-B[2]: A distance between the smoothing section SMO of the generation circuit 20-A[3] and the smoothing section SMO of the generation circuit 20-B[2] is shorter than a distance between the smoothing section SMO of the generation circuit 20-A[3] and the smoothing section SMO of the generation circuit 20-B[2].

The generation circuit 20-A[3] corresponds to the "first generation circuit that generates a first drive waveform signal". The generation circuit 20-B[2] that generates the drive waveform signal Com-B corresponds to a "fifth generation circuit that generates a fifth drive waveform signal". The modulating section MOD of the generation circuit 20-A[3] corresponds to a "first modulating section". The amplifying section TR of the generation circuit 20-A[3] corresponds to a "first amplifying section". The smoothing section SMO of the generation circuit 20-A[3] corresponds to a "first smoothing section". The modulating section MOD of the generation circuit 20-B[2] corresponds to a "second modulating section". The amplifying section TR of the generation circuit 20-B[2] corresponds to a "second amplifying section". The smoothing section SMO of the generation circuit 20-B[2] corresponds to a "second smoothing section".

8. Configuration and Operation of Drive Circuit

Figure 11:
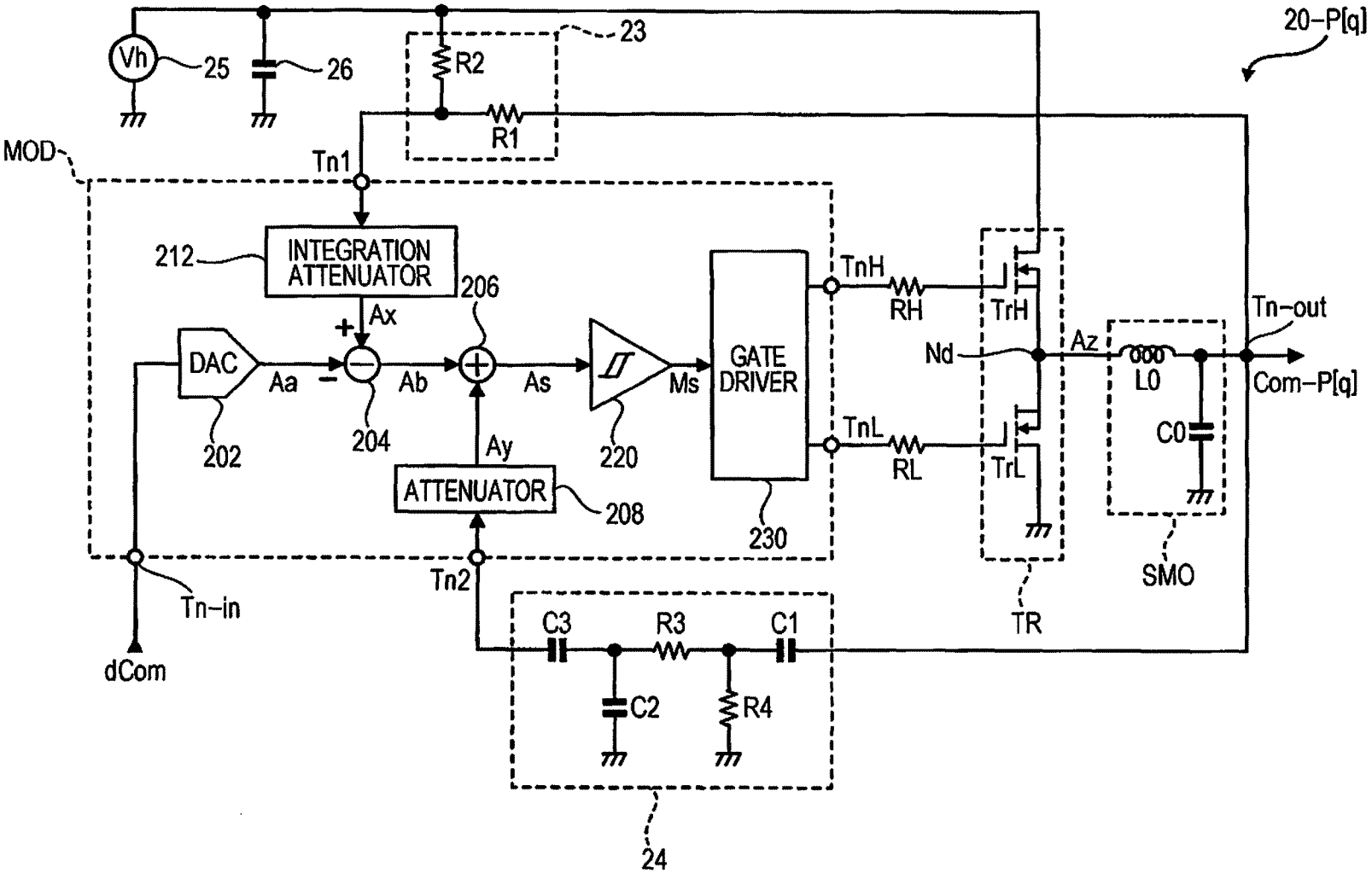
FIG. 11 illustrates a circuit configuration of one of two generation circuits provided in a drive circuit.

FIG. 11 illustrates a circuit configuration of one of two generation circuits 20-P[q] provided in the drive circuit 20[q]. As illustrated in FIG. 11, the generation circuit 20-P[q] generates the drive waveform signal Com-P[q] based on a waveform-designating signal dCom. As described above, the generation circuit 20-P[q] is a generic name for the generation circuit 20-A[q] and the generation circuit 20-B[q].

The generation circuit 20-P[q] performs the following operations: first, converts the digital waveform-designating signal dCom that is supplied from the controller 6 into an analog signal; second, feeds back the drive waveform signal Com-[q] output, corrects the difference between a signal (attenuated signal) that is generated based on the drive waveform signal Com-P[q] and a target signal using high frequency components of the drive waveform signal Com-P[q], and generates a modulation signal in accordance with the corrected signal; third, generates an amplified signal by switching the transistors in accordance with the modulation signal; and fourth, smooths (demodulates) the amplified signal by a low-pass filter and outputs the smoothed signal as a drive waveform signal Com-P[q].

Hereinafter, a configuration of the generation circuit 20-P[q] is described. As illustrated in FIG. 11, the generation circuit 20-P[q] includes the modulating section MOD that is a large-scale integrated (LSI) circuit, the amplifying section TR that includes the transistors TrH and TrL, the smoothing section SMO that includes the coil L0, the capacitor 26 for power supply, the capacitor 26 being connected to the generation circuit 20-P[q] and the power supply circuit 25, and components such as resistors and capacitors. The power supply circuit 25 that supplies electric power to the generation circuit 20-P[q] is provided inside the ink jet printer 1, and the installation location is not limited to a certain location.

As illustrated in FIG. 11, to the modulating section MOD, the waveform-designating signal dCom is input from the controller 6 via an input terminal Tn-in. The modulating section MOD inputs gate signals based on the waveform-designating signal dCom, for example, to the gates of the transistors TrH and TrL. In this embodiment, as an example, it is assumed that the transistors TrH and TrL are n-channel type field effect transistors (FETs).

As illustrated in FIG. 11, the modulating section MOD includes a digital-to-analog converter (DAC) 202, a subtractor 204, an adder 206, an attenuator 208, an integration attenuator 212, a comparator 220, and a gate driver 230. The DAC 202 converts the waveform-designating signal dCom that designates a waveform of the drive waveform signal Com-P[q] into an analog signal Aa, and supplies the signal Aa to an input (−) of the subtractor 204. The voltage amplitude of the signal Aa is, for example, about 0 to 2 volts, and the voltage is amplified about 20 times to generate the drive waveform signal Com-P[q]. In other words, the signal Aa is a signal to be a target before the amplification of the drive waveform signal Com-P[q].

The integration attenuator 212 attenuates and integrates the drive waveform signal Com-P[q] that has been fed back via a terminal Tn1 and supplies a signal Ax to an input (+) of the subtractor 204. The subtractor 204 supplies a signal Ab that indicates a voltage obtained by subtracting the voltage at the input (−) from the voltage at the input (+) to the adder 206. The power source voltage of the circuit from the DAC 202 to the comparator 220 is 3.3 volts, which is a low amplitude. In other words, the voltage of the signal Aa is about 2 volts at maximum. On the other hand, the voltage of the drive waveform signal Com-P[q] may exceed 40 volts. Accordingly, the integration attenuator 212 attenuates the voltage of the drive waveform signal Com-P[q] to adjust the amplitude range of the signal Ax to the amplitude range of the signal in the circuit from the DAC 202 to the comparator 220.

The attenuator 208 attenuates high frequency components of the drive waveform signal Com-P[q] that has been fed back via a terminal Tn2 and supplies a signal Ay to the adder 206. The attenuation in the attenuator 208 is performed similarly to the integration attenuator 212 to adjust the amplitude range of the signal Ay to the amplitude range of the signal in the circuit from the DAC 202 to the comparator 220.

The adder 206 adds a voltage indicated by the signal Ab and a voltage indicated by the signal Ay and supplies a signal As that indicates the added voltage to the comparator 220. The voltage indicated by the signal As is obtained by subtracting the voltage indicated by the signal Aa from the voltage indicated by the signal Ax, which is generated by attenuating a signal supplied to the terminal Tn1, and adding the voltage indicated by the signal Ay, which is generated by attenuating a signal supplied to the terminal Tn2. In other words, the voltage indicated by the signal As is a signal obtained by subtracting a voltage indicated by the signal Aa, which is a target, from an attenuated voltage of the drive waveform signal Com-P[q] that is output from the output terminal Tn-out and correcting the difference by high frequency components of the drive waveform signal Com-P[q].

The comparator 220 outputs a modulation signal Ms that is obtained by performing pulse modulation on the signal As. Specifically, the comparator 220 outputs the modulation signal Ms of a H level when the voltage indicated by the signal As rises and becomes equal to or greater than a threshold voltage Vth1, and outputs the modulation signal Ms of a L level when the voltage indicated by the signal As falls and becomes less than a threshold voltage Vth2. The threshold voltage is set to a relationship "Vth1>Vth2".

The modulation signal Ms is supplied to the gate driver 230. The gate driver 230 converts the modulation signal Ms into a high-logic amplitude gate signal and supplies the gate signal to the gate electrode of the transistor TrH via the terminal TnH and a resistor RH, and inverts the logic level of the modulation signal Ms and converts the signal into a high-logic amplitude gate signal and supplies the gate signal to the gate electrode of the transistor TrL via the terminal TnL and a resistor RL. Accordingly, the logic levels of the gate signals supplied to the gate electrodes of the transformers TrH and TrL are mutually exclusive. A timing control may be performed such that the logic levels of the two gate signals that are output by the gate driver 230 do not become the H level at the same time. In other words, the exclusive relationship here means that the logic levels of the gate signals supplied to the gate electrodes of the transistors TrH and TrL do not become the H level at the same time (that is, the transistors TrH and TrL are not turned on at the same time).

The modulation signal Ms in this embodiment is only an example, and the modulation signal may be any signal that can drive the transistors TrH and TrL in accordance with the waveform-designating signal dCom. In other words, the modulation signal is not limited to the modulation signal Ms, which is a modulation signal in a narrow sense, and the modulation signal includes a signal of a logic level opposite to that of the modulation signal Ms, and a signal on which a timing control is performed so as not to turn on the transistors TrH and TrL at the same time.

The modulating section MOD generates a modulation signal based on a waveform-designating signal for designating a waveform of the drive waveform signal Com-P[q]. In other words, the modulating section MOD according to the embodiment generates the modulation signal Ms based on the waveform-designating signal dCom. Specifically, the modulating section MOD includes the DAC 202, the subtractor 204, the adder 206, and the comparator 220. In this embodiment, as an example waveform-designating signal, the waveform-designating signal dCom is described. Alternatively, the waveform-designating may be a signal that determines a target value for generating the drive waveform signal Com-P[q], for example, the waveform-designating signal may be the analog signal Aa. When the signal Aa is the waveform-designating signal, the modulating section MOD may omit the DAC 202. When the modulation signal is taken in a broad sense, that is, when the modulation signal includes not only the modulation signal Ms in a narrow sense, but also a signal of an opposite logic level of the modulation signal Ms or the like, the modulating section MOD may include the gate driver 230.

As illustrated in FIG. 11, the amplifying section TR includes the transistors TrH and TrL. In the transistors TrH and TrL, a drain electrode of the transistor TrH (high-side transistor) on a high side is connected to the power supply circuit 25 and a voltage Vh (for example, 42 volts) is supplied to the drain electrode. A source electrode of the transistor TrL (low-side transistor) on a low side is connected to a ground. The transistors TrH and TrL are turned on when the gate signals are at H level respectively. Accordingly, at a node Nd that connects the source electrode of the transistor TrH and the drain electrode of the transistor TrL, an amplified signal Az that is obtained by amplifying the modulation signal Ms is supplied. In other words, the transistors TrH and TrL output an amplified signal that is obtained by amplifying a modulation signal Ms. As described above, the amplifying section TR generates the amplified signal Az, which is obtained by amplifying the modulation signal Ms.

As illustrated in FIG. 11, the smoothing section SMO includes a low pass filter (LPF) that smooths the amplified signal Az and generates a drive waveform signal Com-P[q]. The smoothing section SMO includes an inductor L0 and a capacitor C0. One end of the inductor L0 is electrically connected to the node Nd and the other end is electrically connected to the output terminal Tn-out. One end of the capacitor C0 is electrically connected to the output terminal Tn-out and the other end is connected to a ground.

As illustrated in FIG. 11, the generation circuit 20-P[q] includes a pull-up circuit 23 that pulls up the drive waveform signal Com-P[q] output to the output terminal Tn-out and feeds back the drive waveform signal Com-P[q] to the terminal Tn1. The pull-up circuit 23 includes a resistor R1 and a resistor R2. One end of the resistor R1 is electrically connected to the output terminal Tn-out and the other end is electrically connected to the terminal Tn1. One end of the resistor R2 is electrically connected to the terminal Tn1 and the other end is electrically connected to the power supply circuit 25, and to the resistor R2, a voltage Vh is applied.

As illustrated in FIG. 11, the generation circuit 20-P[q] includes a band pass filter (BPF) 24 that cuts direct-current components of the high-frequency drive waveform signal Com-P[q] and feeds back the high frequency components to the terminal Tn2. The BPF 24 includes a resistor R3, a capacitor C1, a resistor R4, a capacitor C2, and a capacitor C3. One end of the capacitor C1 is electrically connected to the output terminal Tn-out and the other end is electrically connected to one end of the resistor R3. One end of the resistor R4 is electrically connected to one end of the resistor R3 and the other end is connected to a ground. One end of the capacitor C2 is electrically connected to the other end of the resistor R3 and the other end is connected to a ground. One end of the capacitor C3 is electrically connected to the other end of the resistor R3 and the other end is electrically connected to the terminal Tn2. Among the components, the capacitor C1 and the resistor R4 function as a high pass filter (HPF) through which high frequency components of a drive waveform signal Com-P[q] higher than or equal to a cutoff frequency pass. The cutoff frequency of the HPF is set to about 9 MHz, for example. Among the components, the resistor R3 and the capacitor C2 function as a low pass filter (LPF) through which low frequency components of a drive waveform signal Com-P[q] lower than or equal to a cutoff frequency pass. The cutoff frequency of the LPF is set to about 160 MHz, for example. In this embodiment, in the BPF 24, the cutoff frequency of the HPF is lower than the cutoff frequency of the LPF. Consequently, the BPF 24 passes frequency components of a drive waveform signal Com-P[q] in a certain band higher than or equal to the cutoff frequency of the HPF and lower than or equal to the cutoff frequency of the LPF. Since the BPF 24 has the capacitor C3, the BPF 24 feeds back a signal, which is obtained by cutting the direct current components of the drive waveform signal Com-P[q] that has passed through the HPF and LPF and in the predetermined band, to the terminal Tn2.

As illustrated in FIG. 11, the generation circuit 20-P[q] smooths the amplified signal Az at the node Nd by the smoothing section SMO to generate the drive waveform signal Com-P[q]. The drive waveform signal Com-P[q] is integrated and subtracted by the integration attenuator 212 and fed back to the subtractor 204. Consequently, self-oscillation occurs due to the delay (the sum of the delay in the smoothing section SMO and the delay in the integration attenuator 212) in feedback and the frequency determined by the transfer function of the feedback. However, since the delay amount in the feedback path via the terminal Tn1 is large, it is difficult to increase the self-oscillation frequency high enough to ensure sufficient accuracy of the waveform of the drive waveform signal Com-P[q] only by the feedback via the terminal Tn1. To solve the problem, in this embodiment, the feedback path for the high frequency components of the drive waveform signal Com-P[q] via the terminal Tn2 is provided, and thereby the delay in the whole generation circuit 20-P[q] can be reduced. In other words, in this embodiment, as compared with a generation circuit that is not provided with the path via the terminal Tn2, the frequency of the signal As, which is obtained by adding the signal Ab and the signal Ay, which is the high-frequency components of the drive waveform signal Com-P[q], can be increased. Accordingly, the accuracy of the drive waveform signal Com-P[q] can be sufficiently ensured.

In this embodiment, the frequency (frequency of the modulation signal Ms) of the self-oscillation is 1 MHz or more and 8 MHz or less. The modulation signal Ms having the frequency achieves both sufficiently ensuring the accuracy of the waveform of the drive waveform signal Com-P[q] and suppressing the switching loss in the transistors TrH and TrL.

B. Modifications

The above-described embodiment may be modified in various ways. Specific modifications will be described below. Two or more modifications selected from those below may be combined without a contradiction between them. In the modifications described below, the reference numerals used in the above description will be used to components that operate or serve similarly to those in the embodiment, and detailed descriptions of the components will be omitted.

Modification 1

In the above-described embodiment, as an example, the four head units HU[1] to HU[4] respectively correspond to the four drive circuits 20[1] to 20[4] in a one-to-one relationship. Alternatively, the above-described embodiment can be modified such that L head units HU[1] to HU[L] respectively correspond to L drive circuits 20[1] to 20[L] in a one-to-one relationship (the variable L is a natural number greater than or equal to 5). In this case, the drive circuits 20 that correspond to head units that are most frequently used may be arranged near the inlet 91. In the example illustrated in FIG. 9, the region of the circuit board 21 is equally divided into the region AL and the region AR by the central line CL2. In both region AL and region AR, the two drive circuits 20 are disposed respectively. The arrangement of the drive circuits 20, however, is not limited to the example in this embodiment. When many drive circuits 20 are to be arranged in the circuit board 21, the drive circuits 20 may be arranged as described below. For example, to arrange twelve drive circuits 20 in the circuit board 21, the region of the circuit board 21 may be divided into three equal regions in the Y-axis direction, and four drive circuits 20 may be disposed in each of the equally divided three regions.

Modification 2

In the above-described embodiment and modification, it is assumed that the head units HU[2] and HU[3] are frequently used. However, for example, in layout printing, a plurality of pages are printed on one sheet of paper, and the head units HU[2] and HU[3] are not always used more frequently than other head units. When layout printing is frequently performed, the head units HU[1] and HU[4], which are far from the central section CL1, may be used more frequently than the head units HU[2] and HU[3], which are close to the central section CL1. If it is assumed that such layout printing is frequently performed, the drive circuit 20[1] corresponding to the head unit HU[1] and the drive circuit 20[4] corresponding to the head unit HU[4] may be disposed near the inlet 91. Furthermore, in the above- described embodiment, as illustrated in FIG. 2, the four head units HU[1] to HU[4] are disposed below (−Z direction) the circuit board 21 (drive circuits 20[1] to 20[4]). However, the positional relationship among each of the four head units HU[1] to HU[4] and the circuit board 21 may be any arrangement, and is not limited to the example illustrated in FIG. 2.

Modification 3

In the above-described embodiment and modifications, as illustrated in FIG. 2, the inlet 91 is provided in the first wall section 93[1] and the outlet 92 is provided in the second wall section 93[2]. However, the positional relationship between the inlet 91 and the outlet 92 may be any relationship, and is not limited to the example illustrated in FIG. 2. For example, the inlet 91 may be provided at an end portion of the third wall section 93[3] on the −Z side, and the outlet 92 may be provided at an end portion of the fourth wall section 93[4] on the +Z side. Alternatively, the inlet 91 may be provided in the second wall section 93[2], and the outlet 92 may be provided in the first wall section 93[1]. Furthermore, in the example illustrated in FIG. 2, the opening (the surface including the opening) of the storage section 90A is parallel to the Y-Z plane. Alternatively, the opening of the storage section 90A may be perpendicular to the Y-Z plane. However, considering that the temperature of air that has flowed into the shielding case 90 through the inlet 91 rises in the shielding case 90, it is preferable that the opening in the storage section 90A be parallel to the Y-Z plane, as illustrated in FIG. 2. Furthermore, it is preferable that the outlet 92 be provided to be closer to the +Z side than the inlet 91.

Modification 4

In the above-described embodiment and modifications, as illustrated in FIG. 9, in the region AL, the generation circuit 20-A[q] in the drive circuit 20[q] is disposed to be closer to the +Z side than the generation circuit 20-B[q] in the drive circuit 20[q], and in the region AR, the generation circuit 20-A[q] in the drive circuit 20[q] is disposed to be closer to the −Z side than the generation circuit 20-B[q] in the drive circuit 20[q]. However, the positional relationship between the generation circuit 20-A[q] in the drive circuit 20[q] and the generation circuit 20-B[q] in the drive circuit 20[q] is not limited to the example in FIG. 9. A specific example is described below. In the example in FIG. 9, in the region AL, in the −Z direction, the four generation circuits 20-P[q] are disposed in the order of the generation circuit 20-A[1], the generation circuit 20-B[1], the generation circuit 20-A[2], and the generation circuit 20-B[2]. In the region AR, in the −Z direction, the four generation circuits 20-P[q] are disposed in the order of the generation circuit 20-B[4], the generation circuit 20-A[4], the generation circuit 20-B[3], and the generation circuit 20-A[3]. However, in the region AL, in the −Z direction, the four generation circuits 20-P[q] may be disposed in the order of the generation circuit 20-B[1], the generation circuit 20-A[1], the generation circuit 20-B[2], and the generation circuit 20-A[2]. In the region AR, in the −Z direction, the four generation circuits 20-P[q] may be disposed in the order of the generation circuit 20-A[4], the generation circuit 20-B[4], the generation circuit 20-A[3], and the generation circuit 20-B[3].

Modification 5

In the above-described embodiment and modifications, the generation circuit 20-P[q] generates the modulation signal Ms based on the waveform-designating signal dCom, controls on or off of the transistors TrH and TrL depending on the signal level of the modulation signal Ms to amplify the modulation signal Ms to generate the amplified signal Az, and smooths the amplified signal Az to generate the drive waveform signal Com-P[q], that is, the generation circuit 20-P[q] is a class D amplifier circuit. However, the invention is not limited to the embodiment and modifications. The generation circuit 20-P[q] may be an amplifier circuit that amplifies a waveform-designating signal such as the signal Aa, which is generated by converting the waveform-designating signal dCom into an analog signal, to generate the drive waveform signal Com-P[q]. For example, the generation circuit 20-P[q] may be an amplifier circuit that includes a transistor for amplifying a waveform indicated by a waveform-designating signal.

Modification 6

In the above-described embodiment and modifications, the ink jet printer 1 is the line printer that has the nozzle arrays Ln arranged such that the range YNL covers the range YP. However, the invention is not limited to this example, and the ink jet printer 1 may be a serial printer that performs print processing while reciprocating the liquid discharge head 3 in the Y-axis direction.

Modification 7

In the above-described embodiment and modifications, the ink jet printer 1 can discharge the inks of four colors of CMYK. However, the invention is not limited to this example, and the ink jet printer 1 may discharge ink of at least one color, and the ink colors may be colors other than the CMYK. Furthermore, in above-described embodiment and modifications, the ink jet printer 1 includes the four nozzle arrays Ln. Alternatively, the ink jet printer 1 may include at least one nozzle array Ln.

Modification 8

In the above-described embodiment and modifications, the drive waveform signal Com-B includes only the microvibration waveform so as not to cause the liquid discharge head 3 to discharge the ink. However, the invention is not limited to this example, and the drive waveform signal Com-B may be a signal that includes a discharge waveform and the amplitude of the signal is smaller than that of the drive waveform signal Com-A.

Modification 9

In the above-described embodiment and modifications, the drive signal Com includes the signals of two systems: the drive waveform signal Com-A and the drive waveform signal Com-B. However, the invention is not limited to this example, and the drive signal Com may include a signal of at least one system. For example, the drive signal Com may include signals of three systems: drive waveform signals Com-A, Com-B, and Com-C. In the above-described embodiment and modifications, the unit period Tu includes the control periods Ts1 and Ts2. However, the invention is not limited to this example, and the unit period Tu may be a single control period Ts or may include three or more control periods Ts. Furthermore, in the above-described embodiment and modifications, the print signal SI is the 2-bit signal. Alternatively, the number of bits of the print signal SI may be appropriately determined depending on the number of control periods Ts in the unit period Tu, the number of systems of the signals included in the drive signal Com, or the like.

What is claimed is:

1. A liquid discharge apparatus comprising:
- a first head unit configured to discharge a liquid;
- a second head unit configured to discharge a liquid;
- a first drive circuit configured to drive the first head unit;
- a second drive circuit configured to drive the second head unit;
- a circuit board on which the first drive circuit and the second drive circuit are provided; and
- a case that accommodates the circuit board,
- wherein the case includes;
  - an inlet through which gas outside the case flows inside the case; and
  - an outlet through which gas inside the case flows to the outside the case; and
- the first drive circuit generates more heat than the second drive circuit, and a distance between the first drive circuit and the inlet is shorter than a distance between the second drive circuit and the inlet.

2. The liquid discharge apparatus according to claim 1, wherein the first drive circuit and the second drive circuit are located between the inlet and the outlet.

3. The liquid discharge apparatus according to claim 1, further comprising:
- a power supply circuit configured to supply electric power to the first drive circuit; and a capacitor for power supply, the capacitor being electrically connected to the first drive circuit and the power supply circuit, wherein the capacitor for power supply is disposed on the circuit board and located between the inlet and the outlet.

4. The liquid discharge apparatus according to claim 1, further comprising:

a line head including the first head unit and the second head unit, the line head extending in a predetermined direction, wherein a distance between a central section of the line head in the predetermined direction and the first head unit is shorter than a distance between the central section and the second head unit.

5. The liquid discharge apparatus according to claim 1, wherein the first drive circuit includes:

a first generation circuit configured to generate a first drive waveform signal for driving the first head unit; and a second generation circuit configured to generate a second drive waveform signal for driving the first head unit; and the second drive circuit includes:

a third generation circuit configured to generate a third drive waveform signal for driving the second head unit; and a fourth generation circuit configured to generate a fourth drive waveform signal for driving the second head unit; and the first generation circuit generates more heat than the second generation circuit, the third generation circuit generates more heat than the fourth generation circuit, and a distance between the first generation circuit and the second generation circuit is shorter than a distance between the first generation circuit and the third generation circuit.

6. The liquid discharge apparatus according to claim 5, wherein a distance between the third generation circuit and the fourth generation circuit is shorter than a distance between the third generation circuit and the first generation circuit.

7. The liquid discharge apparatus according to claim 1, wherein the first drive circuit includes:

a first generation circuit configured to generate a first drive waveform signal for driving the first head unit; and a second generation circuit configured to generate a second drive waveform signal for driving the first head unit, the second drive circuit includes:

a third generation circuit configured to generate a third drive waveform signal for driving the second head unit; and a fourth generation circuit configured to generate a fourth drive waveform signal for driving the second head unit; and an amplitude of the first drive waveform signal is larger than an amplitude of the second drive waveform signal, an amplitude of the third drive waveform signal is larger than an amplitude of the fourth drive waveform signal, and a distance between the first generation circuit and the second generation circuit is shorter than a distance between the first generation circuit and the third generation circuit.

* * * * *